US006808458B1

(12) United States Patent
Jung

(10) Patent No.: US 6,808,458 B1
(45) Date of Patent: Oct. 26, 2004

(54) SPORTING APPARATUS FOR HORSE RIDING

(75) Inventor: Seung-Joo Jung, Jeo l lanam-Do (KR)

(73) Assignee: Pil-Dong Chung, Kyungki-Do (KR)

( * ) Notice: Subject to any disclaimer, the term of this patent is extended or adjusted under 35 U.S.C. 154(b) by 0 days.

(21) Appl. No.: 10/681,988

(22) Filed: Oct. 7, 2003

(30) Foreign Application Priority Data

Apr. 8, 2003 (KR) ..... 10-2003-0021867

(51) Int. Cl.[7] ..... A63G 17/00

(52) U.S. Cl. ..... 472/97; 472/100; 434/55; 434/247

(58) Field of Search ..... 472/59, 60, 95, 472/96, 97, 99, 100, 130, 131, 135; 434/29, 55, 61, 62, 247, 256

(56) References Cited

U.S. PATENT DOCUMENTS

| | | | | |
|---|---|---|---|---|
| 2,485,292 | A | * 10/1949 | Kail | 434/55 |
| 4,984,986 | A | * 1/1991 | Vohnout | 434/247 |
| 5,085,425 | A | * 2/1992 | Collins et al. | 472/97 |
| 5,946,721 | A | 9/1999 | Dance | |
| 5,951,404 | A | * 9/1999 | Oishi et al. | 472/60 |
| 6,059,666 | A | * 5/2000 | Ohara et al. | 472/97 |
| 6,162,058 | A | * 12/2000 | Yang | 434/55 |
| 6,402,626 | B1 | * 6/2002 | Beaty | 472/96 |
| 6,616,456 | B1 | * 9/2003 | Nalty et al. | 434/247 |
| 2003/0073504 | A1 | 4/2003 | Ettenhofer | |

FOREIGN PATENT DOCUMENTS

| | | | |
|---|---|---|---|
| GB | 2256597 | * | 12/1992 |
| GB | 2 317 350 | | 3/1998 |
| GB | 2380140 | * | 4/2003 |
| JP | 8117438 | * | 5/1996 |
| JP | 6285201 | * | 8/1996 |
| JP | 2001286578 | * | 10/2001 |
| JP | 2003190347 | * | 7/2003 |
| WO | WO 98/32501 | * | 7/1998 |

* cited by examiner

*Primary Examiner*—Kien Nguyen
(74) *Attorney, Agent, or Firm*—Darby & Darby

(57) ABSTRACT

A horse riding sporting apparatus comprises a saddle support 10 for supporting a saddle 2, the support being disposed in the upper central part of a frame 1; a sliding assembly 20 for moving forward and backward the saddle support 10, the sliding assembly being disposed in the front part of the frame 1; an elevating assembly 30 for moving up and down the saddle support 10, the elevating assembly being disposed in the central part of the frame 1; a buffering member 40 connected to the elevating assembly 30; a first working assembly 50 and a second working assembly 60, for moving up and down the buffering member 40, the assemblies being respectively disposed in the rear and the central part of the frame 1; a driving assembly 70 for driving the sliding assembly 20 as well as the first and second working assemblies 50 and 60; a distance adjusting assembly 80 as well as a first and a second elevation adjusting assembly 90 and 100, respectively for adjusting the sliding distance as well as the vertical elevation; a load adjusting assembly 200 for adjusting the load strength for the saddle support 10, the load adjusting assembly being connected to the elevating assembly 30; and a controller 300 for automatically controlling the operation of the above described components.

22 Claims, 28 Drawing Sheets

SPORTING APPARATUS FOR HORSE RIDING

FIELD OF THE INVENTION

The present invention relates to a sporting apparatus for hose riding and more particularly to a sporting apparatus for horse riding which allows a user to acquire a sporting effect of a horse riding while enjoying the horse riding sport as if on a real horse, without the space restriction even in a narrow indoor space.

BACKGROUND OF THE INVENTION

Generally, the horse riding as a type of sport with a special character requiring the integration with living horses, helps drill a body, cultivate the spirit of knighthood, and revive exhausted energy, and in addition it is a whole body exercise not only for a balanced bodily growth but also for boldness as well as sound mind.

Further, the horse riding, which may be enjoyed both by men and women, can help the correction of posture, as it requires the upright posture, differently from many other exercises. Staying on a shaking horse may be good for fortifying the intestinal function and particularly effective for curing the constipation of students or women and postate disorders for men, etc., and may be a help in improving the breathing capacity and strengthening the lower part of the body like the thigh and calf of the leg.

Accordingly, from the horse riding, a man can have his or her upper body posture corrected and the back and waist flexible and softened and also train the spiritual concentration and body's rhythm sense. The breathing capacity is increased, the pelvic region is fortified and at the same time the courage is grown, while the body is developed in a correct way by cultivating the sense of balancedness of respective bodily parts, the pliability and the like.

Whereas it is well known that the horse riding can have a remarkable effect on the whole body exercise, unfortunately most people can have limited chances of horse riding in practice due to inadequate conditions including the economic ability and incongruent places or timing.

On the other hand, a number of simulated horse riding equipments have appeared for such reasons so that indoor playing may be available. Conventionally presented horse riding equipments, however, provided simply the function of amused play, apart from such an vivid feeling as would be experienced with a real horse riding, not to mention that exercise like feeling is hardly obtained. There is another problem that horse riding movements approximating the rhythms of a real horse are not achieved.

SUMMARY OF THE INVENTION

The present invention is intended to remove the disadvantages of the conventional art as described above. Thus, the object of the invention is to provide a sporting apparatus for horse riding which allows a user to acquire the sporting effects of a horse riding, without the space restriction even in a narrow indoor space, while enjoying the horse riding sport approximating the rhythm and atmosphere of a running horse and full of vividness as if on a real horse, The above object is achieved, according to a preferred aspect of the invention, by a sporting apparatus for horse riding, which comprises a saddle support for supporting a saddle, the support being disposed in the upper central part of a frame; a sliding assembly or traverse assembly for moving back and forth the saddle support, the assembly being disposed in the front part of the frame assembly; an elevating assembly for moving up and down the saddle support, the assembly being disposed in the central part of the frame; a buffering member connected to the elevating assembly; a first and a second working assembly, respectively disposed in the rear and central part of the frame, both being adapted for moving up and down the buffering member; a driving assembly for driving the sliding assembly and the first and second working assemblies; a distance adjusting assembly and a first and second elevation adjusting assemblies, respectively for adjusting the traversing distance for the sliding assembly and for adjusting vertical elevation for the first and second working assemblies; a load adjusting assembly for adjusting the load strength for the saddle support, the assembly being connected to the elevating assembly; and a controller for automatically controlling the operation of those components.

DETAILED DESCRIPTION OF THE INVENTION

Figure 1:
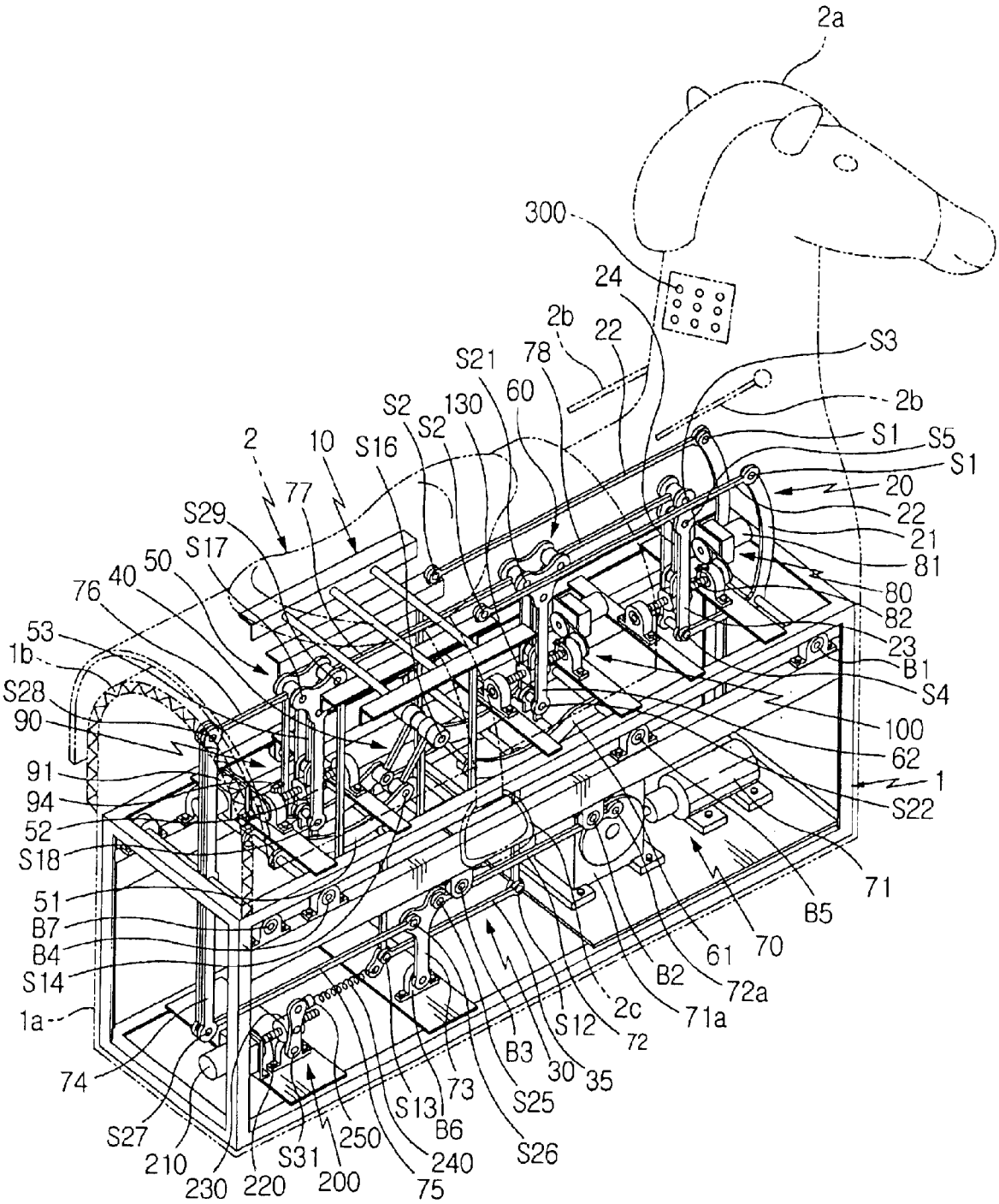
FIG. 1 shows the perspective view of a horse riding sporting apparatus according to the invention, illustrating the general construction of the invention.

A preferred embodiment of the invention is described in detail below by referring to the accompanying drawings.

First, a sporting apparatus for horse riding according to the invention generally comprises, as shown in FIGS. 1 to 19: a saddle support 10 for supporting a saddle 2, the support being disposed in the upper central part of a frame 1; a sliding assembly 20 for moving forward and backward the saddle support 10, the sliding assembly being disposed in the front part of the frame 1; an elevating assembly 30 for moving up and down the saddle support 10, the elevating assembly being disposed in the central part of the frame 1; a buffering member 40 connected to the elevating assembly 30; a first working assembly 50 and a second working assembly 60, for moving up and down the buffering member 40, the assemblies being respectively disposed in the rear and the central part of the frame 1; a driving assembly 70 for driving the sliding assembly 20 as well as the first and second working assemblies 50 and 60; a distance adjusting assembly 80 as well as a first and a second elevation adjusting assembly 90 and 100, respectively for adjusting the sliding distance as well as the vertical elevation; a load adjusting assembly 200 for adjusting the load strength for the saddle support 10, the load adjusting assembly being connected to the elevating assembly 30; and a controller 300 for automatically controlling the operation of the above described components.

Here, the aforementioned frame 1, constituting the framework for the main body of the horse riding apparatus according to the invention, is constructed strongly against any shaking motion during the operation of the apparatus and is provided with a cover 1*a* for preventing the parts disposed inside from exposing externally from the aesthetic view point, and also on the frame 1 with a sound absorbing material 1*b*, as depicted in FIG. 1.

The saddle 2, which is provided to produce such an environment as in riding a real horse by a user or a man intending to conduct the horse riding exercise, is formed nearby with a horse model 2*a* resembling a real horse, is provided with a grip strap 2*b* in the upper front location of the saddle 2 and is provided with footrests 2*c* for staying the users feet in the both lower sides of the saddle 2.

Preferably, as described above, the horse saddle 2 is provided with a horse model 2*a* to increase the atmosphere of real horse riding, although a variety of other animal models including those of a lion, tiger, elephant etc. may be formed if desired as well.

The saddle support 10, which is disposed in the upper central part of the frame 1 so as to be movable back and forth and up and down, serves to support the saddle 2 and therefore it is installed to support the latter strongly, wherein the saddle 2 is removably fixed to the support 10 by clamping a number of bolts and nuts.

Figure 7:
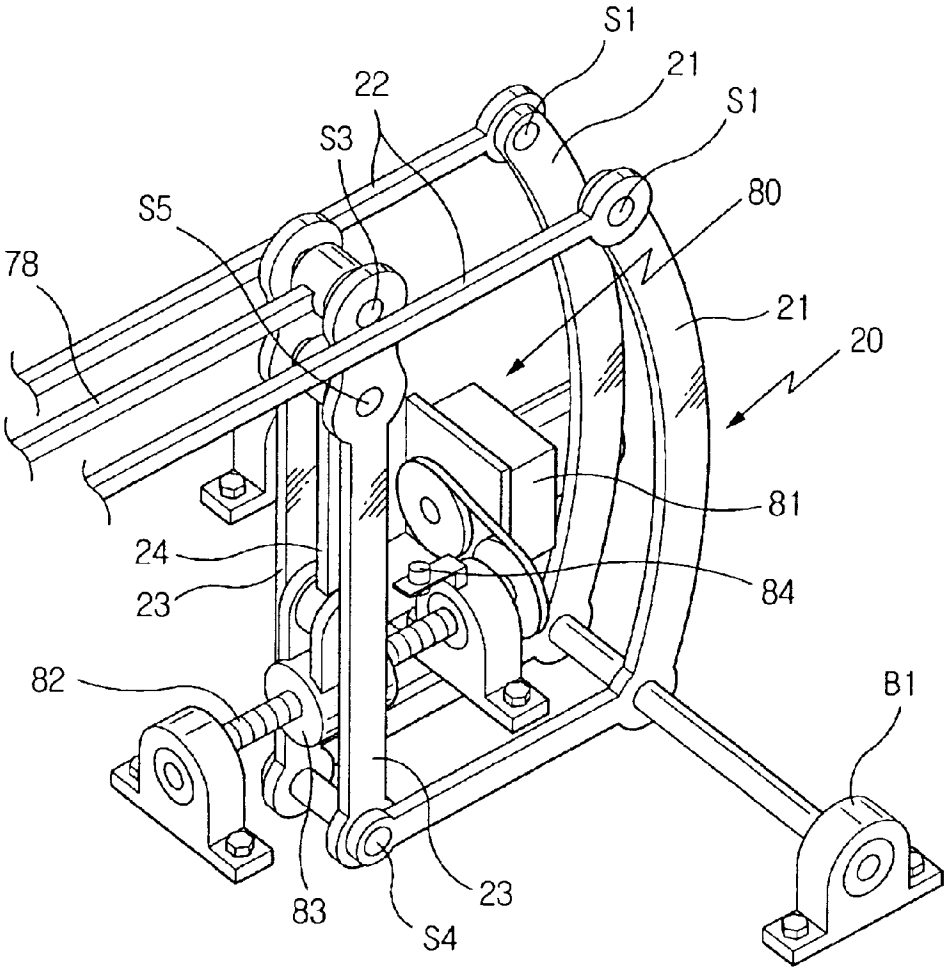
FIG. 7 shows the perspective views for the sliding assembly and the distance adjusting assembly.

The sliding assembly 20, which is disposed in the front part of the frame 1 in order to move the saddle support 10 back and forth, comprises, as shown in FIG. 7, sliding levers 21 fixed to the frame 1 through bearings B1; sliding rods 22, the opposite ends of the sliding rods being connected to the tops of the sliding levers 21 and to the saddle support 10 through axes S1 and S2; elevating levers 23, the tops and bottoms of the elevating levers being respectively connected to the bottom ends of the sliding levers 21 and the driving assembly 70 through axis S4 and S3; and an adjusting rod 24, the top and bottom of the adjusting rod being connected to the elevating levers 23 and the distance adjusting assembly 80 through an axis S5 and S6.

The sliding levers 21 are substantially in the form of L, wherein it is fixed rotatably at its central position to the frame 1 through bearings B1. The sliding levers 21 are such that two units constitute one set of levers, wherein the both sliding levers 21 are integrally connected at their central positions by an axis fitting in the bearings B1.

The sliding rods 22 are such that two units constitute one set of rods, wherein the both ends of the rods are connected to the both vertical tops of the sliding levers 21 and to the both front ends of the saddle support 10 through the axes S1 and axes S2.

The elevating levers 23 are such that two parts constitute one set of levers, wherein the tops of the elevating levers 23 are connected to a third link 78 of the driving assembly 70, the latter being described later in the following, through the axis S3, and the bottoms of the elevating levers 23 are connected to the ends of horizontal parts of the sliding levers 21 through an axis S4.

Figure 2:
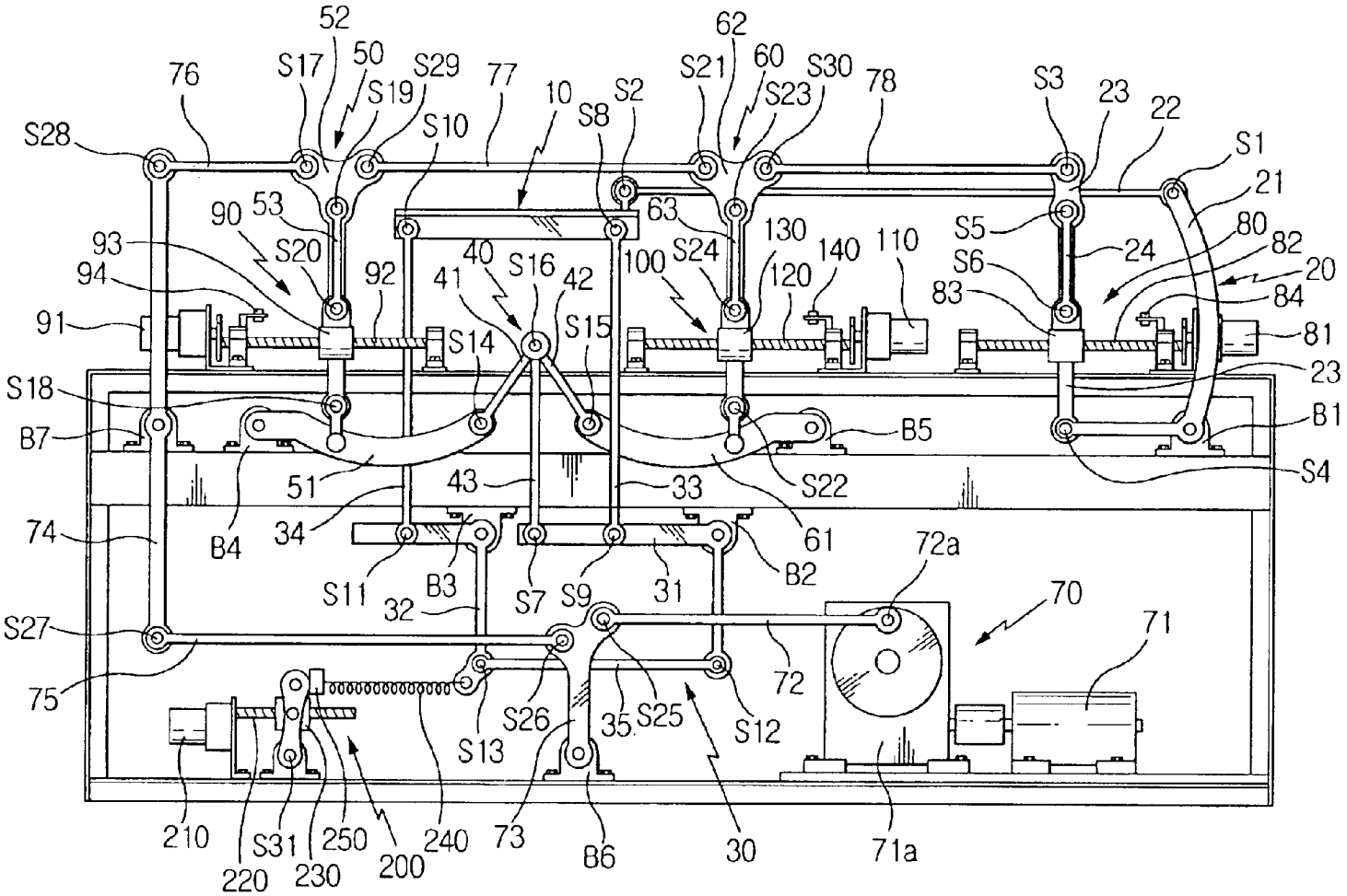
FIG. 2 shows the illustrative front view, illustrating the construction of the invention.
Figure 3:
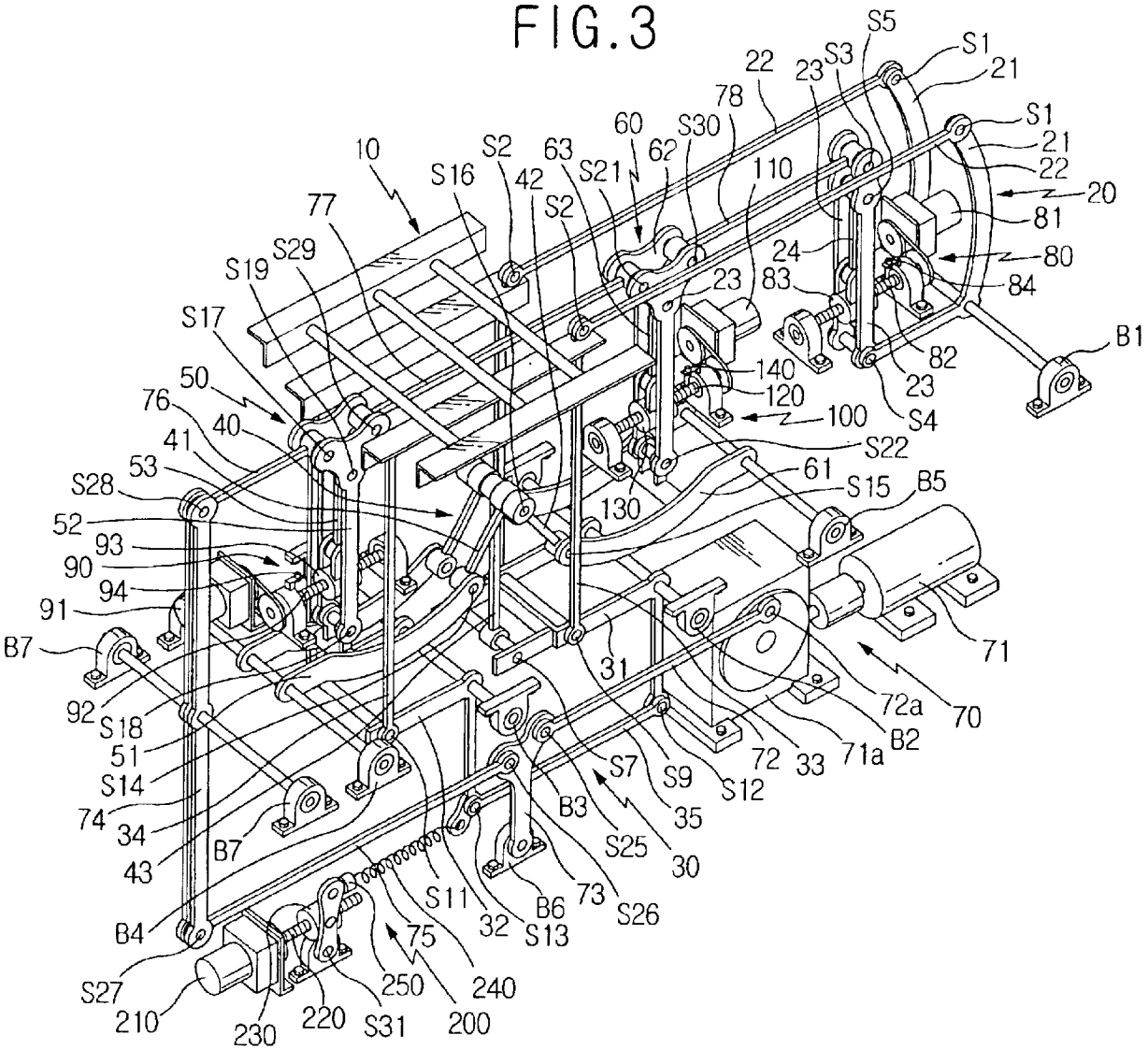
FIGS. 3 and 4 show the perspective views for the essential parts.
Figure 4:
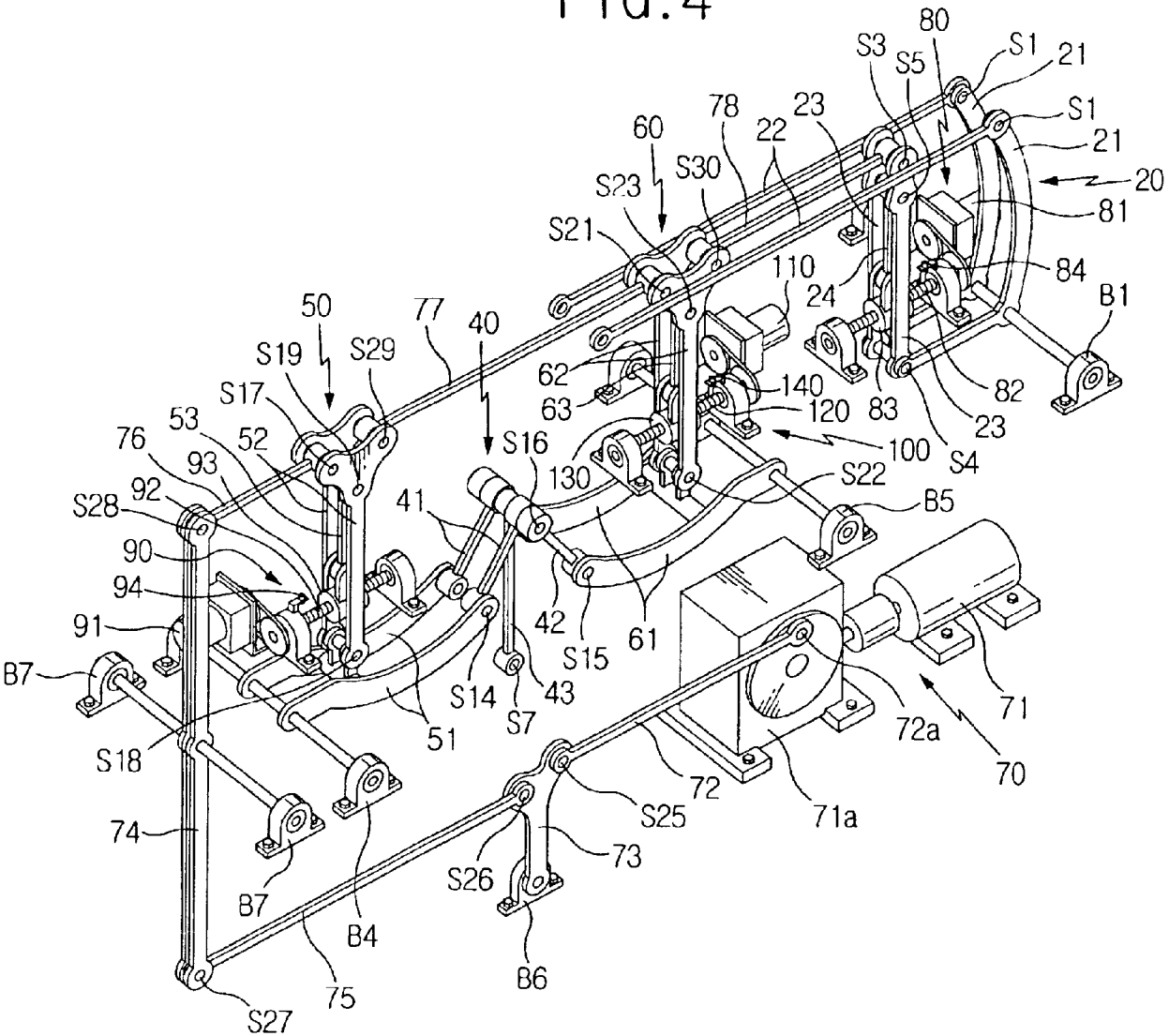

The adjusting rod 24 is disposed between the two vertical parts of the elevating levers 23, wherein the top of the adjusting rod 24 is connected to elevating levers 23 through the axis S5 and the lower end of the adjusting rod 24 is connected, through the axis S6, to an adjusting nut 83 of the distance adjusting assembly 80, the latter being described in more detail below with regard to FIG. 2.

The operation of the sliding assembly 20, constructed as described above, is now described below.

Figure 8A:
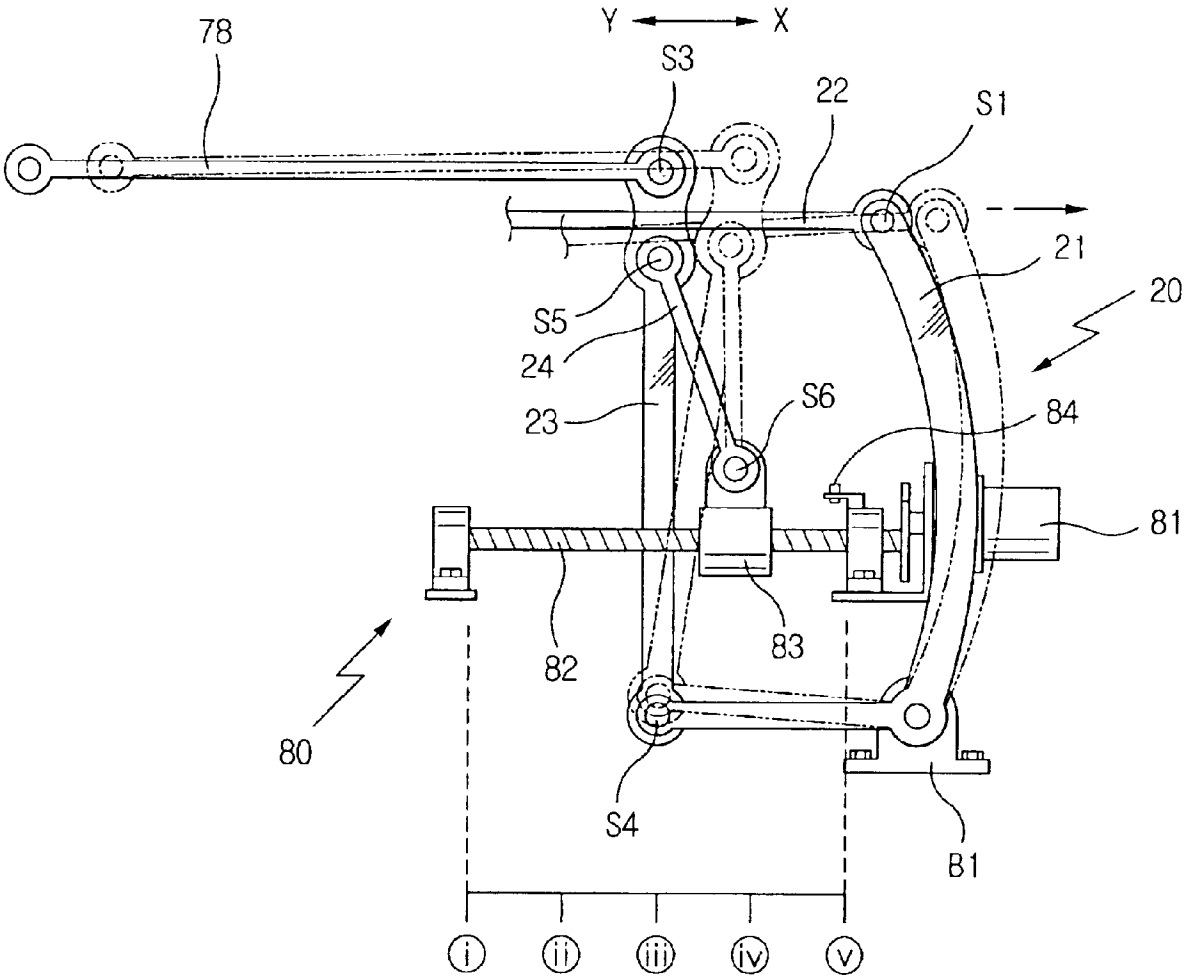
FIGS. 8*a*, 8*b* and 8*c* illustrate the operating states of the arrangement in FIG. 7, FIG. 9 show the perspective view of an elevating assembly.

Referring to FIG. 8*a*, when the third link 78 of the driving assembly 70 is pushed in the direction of X or moved forward, in the state that the axis S6 connected to the bottom of the adjusting rod 24 has been moved to the position iv by adjusting the distance adjusting assembly 80, the elevating levers 23 of the sliding assembly 20 are moved upward as shown in the imaginary or dotted line. At this instant, because the axis S4 is not allowed to move forward or backward but only allowed to turn about the bearings B1 as its axis, so as to be raised or lowered, as can be understood from the drawing, thus the axis S4 of the sliding levers 21 is raised, as shown in the imaginary line, simultaneously with the ascent of and in interlocked relation with the elevating levers 23. Thereby, the axis S1 of the sliding levers 21 is concurrently moved forward, as shown in the imaginary line, pulling the sliding rods 22 forward, as shown with the arrowhead, with the result that the saddle support 10 supporting the saddle 2 is forwarded.

When the third link 78 of the driving assembly 70 is pulled in the direction of Y or moved backward, in the same state as in the foregoing, the elevating levers 23 and the axis S4 are lowered concurrently, and at the same time the axes S1 are moved backward accordingly to pull the sliding rods 22 in the rear direction, resulting in the rearward movement of the saddle support 10 supporting the saddle 2.

Therefore, when the third link 78 of the driving assembly 70 is reciprocated substantially in the horizontal direction, the sliding assembly 20 operating in the same manner as in the above causes the saddle support 10 supporting the saddle 2 to conduct the incidental horizontal reciprocation.

In this case, when the axis S6 of the adjusting rod 24 is adjusted to position the more closely to the extreme right point v, the distance of horizontal movement for the sliding rods 22 relative to that of the third links 78 gets the larger.

Figure 8B:
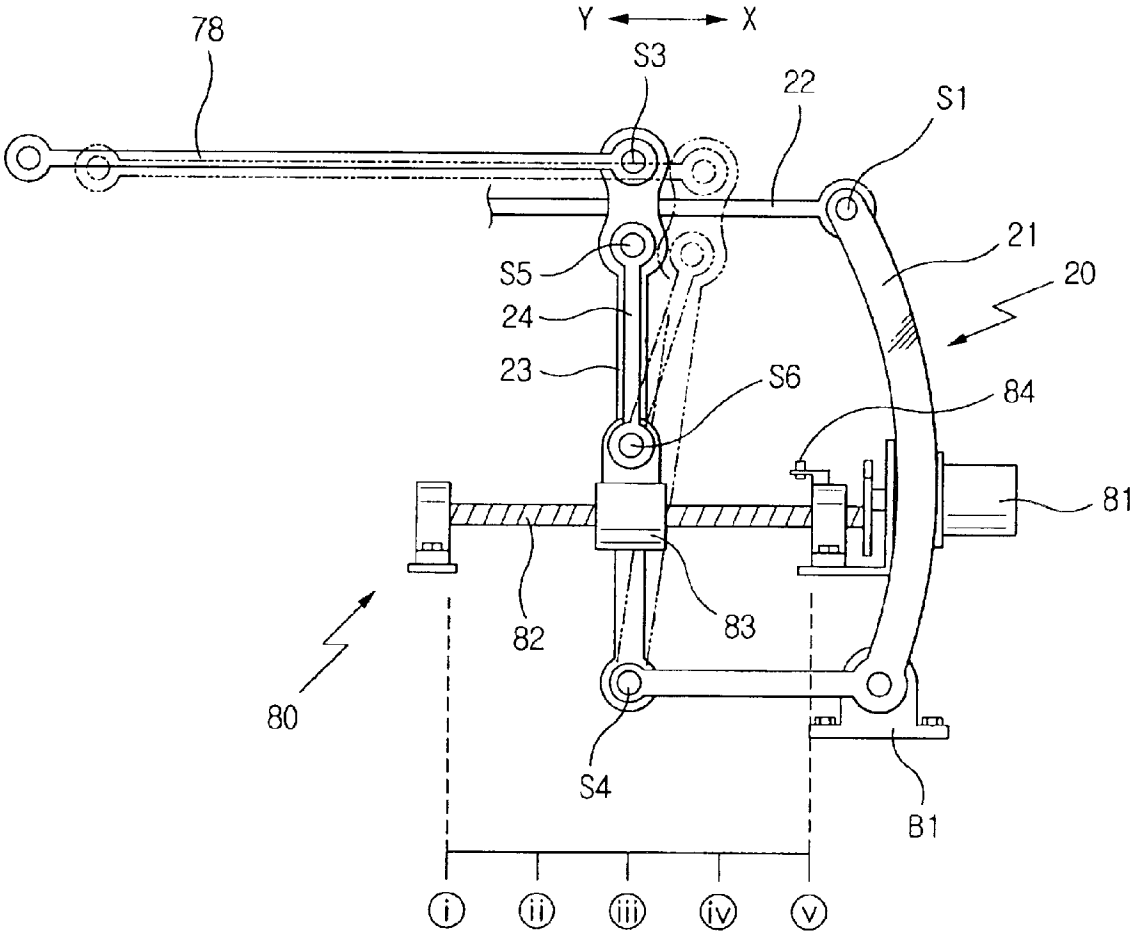

In addition, as shown in FIG. 8*b*, when the axis S6 of the adjusting rod 24 is adjusted to position at the middle point iii, the elevating levers 23 make only little vertical displacement.

Figure 8C:
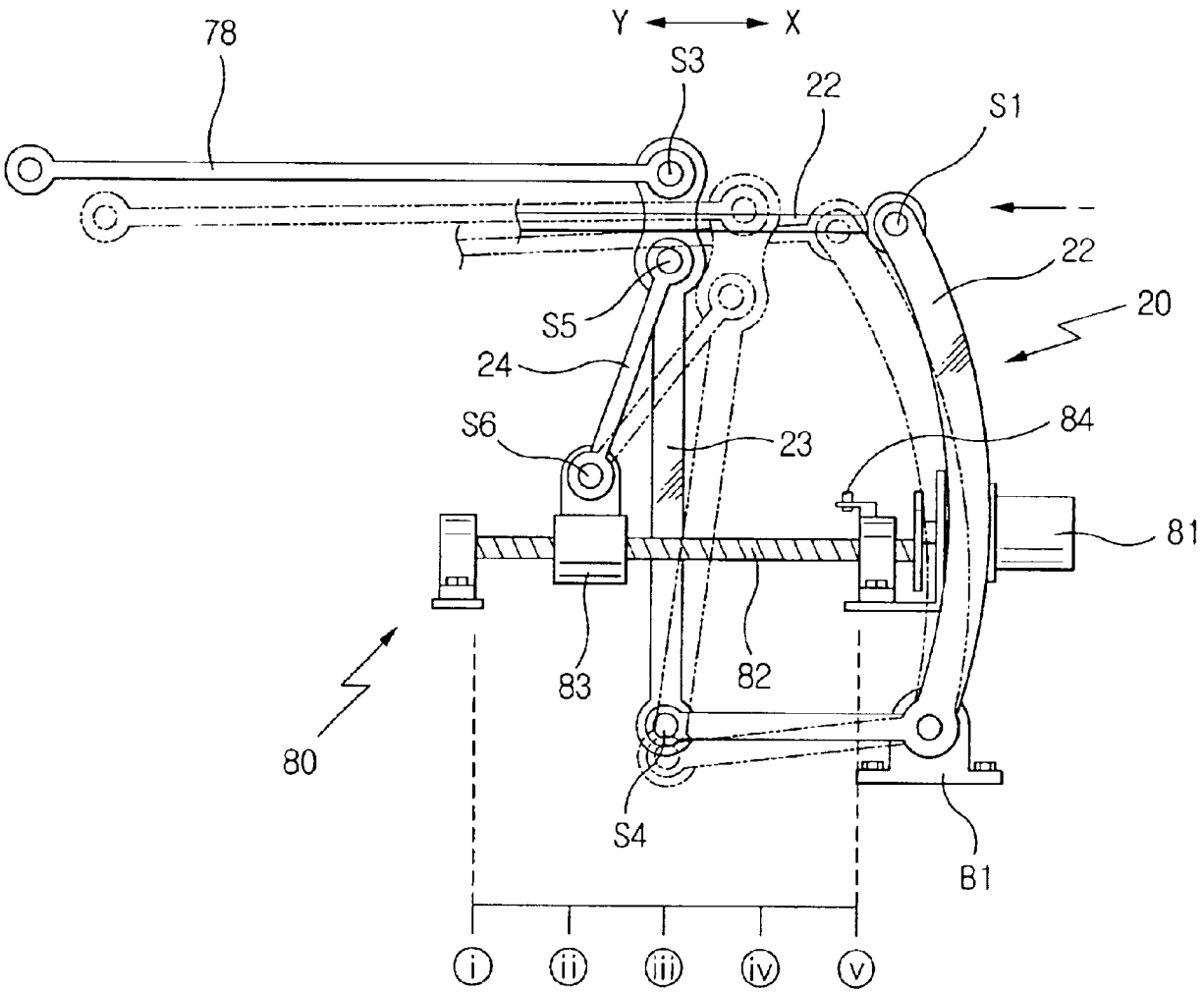

On the other hand, when the third link 78 of the driving assembly 70 is pushed in the X direction, with the axis S6 of the adjusting rod 24 adjusted at the rearward point ii, as shown in FIG. 8*c*, the elevating levers 23 and the axis S4 of the sliding levers 21 are caused to move down, and at the same time, the axes S1 of the sliding levers 21 are moved rearward, as shown in the imaginary line, to pull the sliding rods 22 rearward, as shown in the arrowhead, whereby the saddle support 10 is moved rearward.

On the contrary, when the third link 78 of the driving assembly 70 is pulled in the Y direction, the elevating levers 23 and the axis S4 of the sliding levers 21 are caused to move up, and concurrently the axes S1 of the sliding levers 21 are moved forward, as shown in the solid line, to pull the sliding rods 22 forward, as shown in the corresponding arrowhead, whereby the saddle support 10 is moved in the front direction.

Similarly to the previous case, when the axis S6 of the adjusting rod 24 is adjusted to position the more closely to the extreme left point i in FIG. 8*c*, the distance of horizontal movement for the sliding rods 22 per unit movement of the third links 78 gets the larger.

Figure 9:
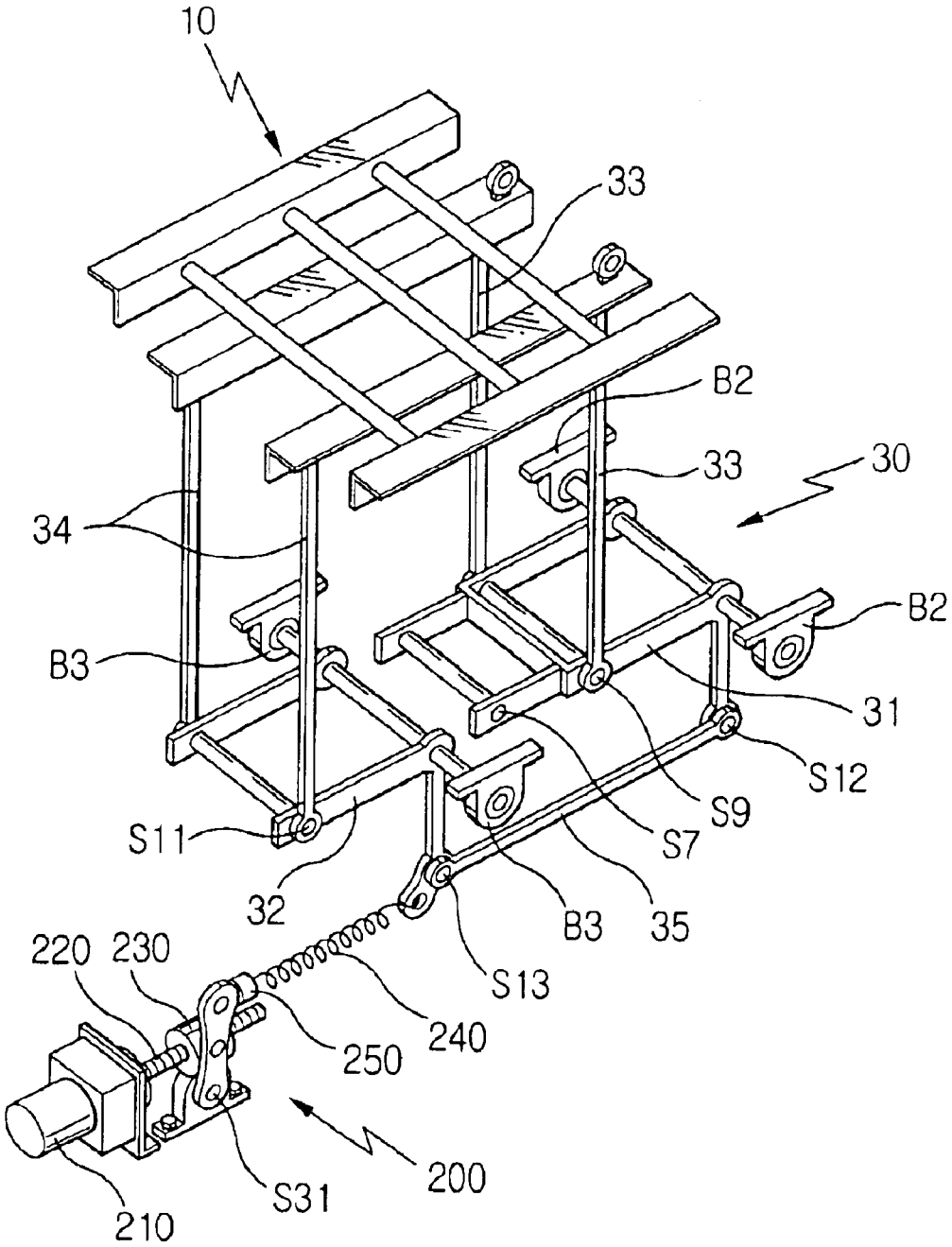

Now referring to FIG. 9, the elevating assembly 30 disposed in the central part of the frame and adapted to move the saddle support 10 up or down is described. As shown in the drawing, the elevating assembly 30 comprises a driving lever 31 fixed to the frame 1 through bearings B2 and connected to the buffering member 40 through an axis S7; driven lever 32 fixed to the frame 1 through a bearing B3; elevating rods 33 and 34, the respective tops and bottoms of elevating rods being connected to the saddle support 10 and to the upper positions of the driving and driven levers 31 and 32 through axes S8, S9; S10, S11; and a connecting rod 35, the opposite ends of connecting rod being connected to the lower ends of the driving and driven levers 31 and 32 through an axis 12 and 13.

The driving lever 31 generally in the form of reversed L is rotatably fixed, about at its middle locations, to the frame 1 through bearings B2, wherein the upper end of the lever 31 is connected to the elevating rod 43 of the buffering member 40 through an axis S7, the buffering member being described later.

The driven lever 32 also generally in the form of reversed L is rotatably fixed, about at its middle point, to the frame 1 through bearings B3.

The elevating rods 33, composed of two same rod parts, are connected, at their tops, to the both front sides of the saddle support 10 via axes S8, and connected, at their bottoms, to the top positions of the driving lever 31 via axes S9.

The elevating rods 34, composed of two same rod parts, are connected, at their tops, to the both rear sides of the saddle support 10 via axes S10, and connected, at their bottoms, to the top positions of the driving lever 32 via axes S11.

The both elevating rods 33 and 34 of the elevating assembly 30 serves to strongly support the saddle support 10 and acts to reciprocate the latter vertically when the driving assembly 70 is driven.

The connecting rod 35, the opposite ends of which are connected to the undersides of the driving and driven levers 31 and 32 via the axis S12 and S13, transmits the motion of the driving lever 31 to the driven lever 32 so as to cause the interlocked operation of the driving and driven levers 31 and 32.

The operation of the elevating assembly 30 constructed as described above is described in some more detail.

Figure 10A:
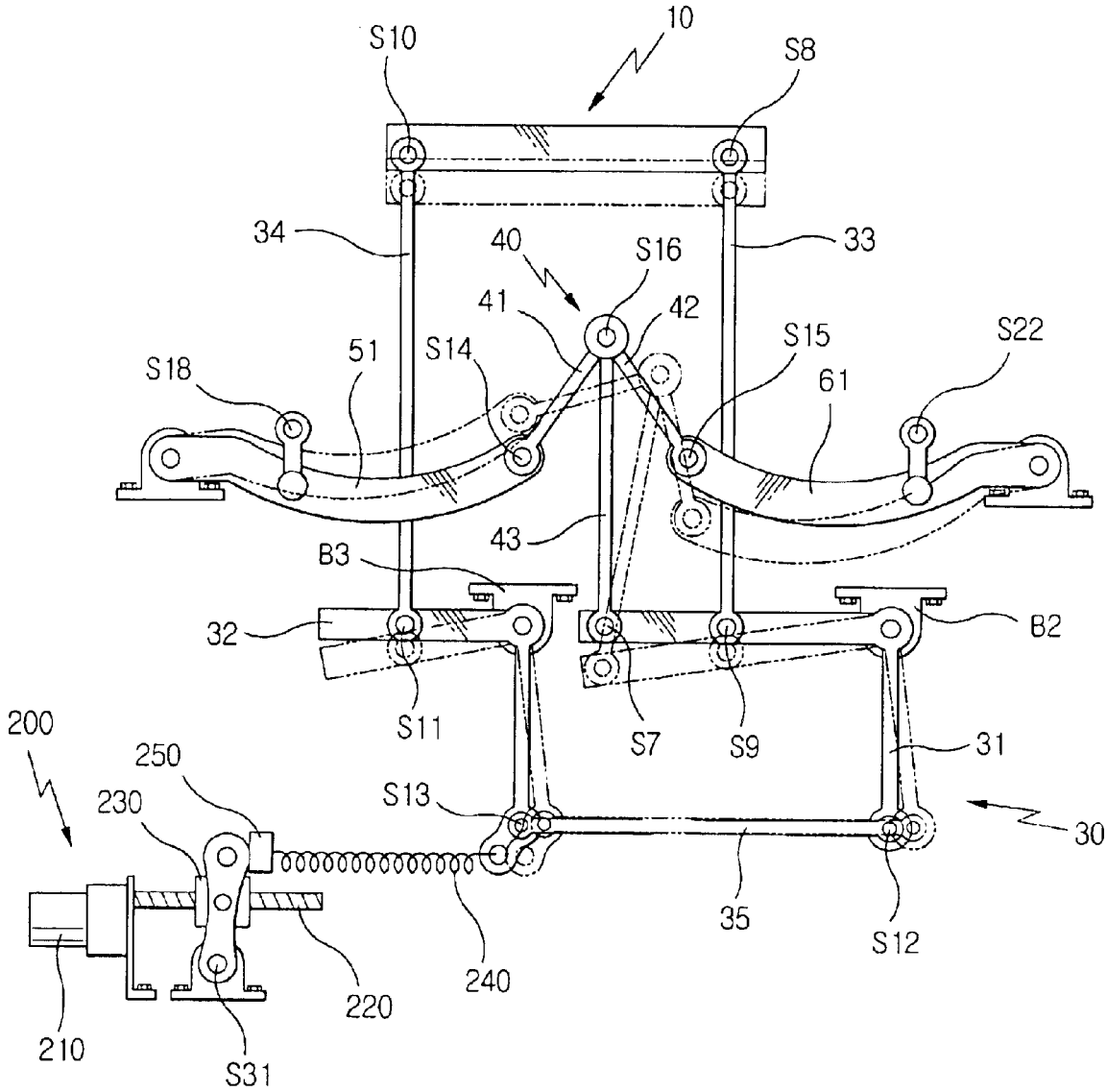
FIGS. 10*a* and 10*b* illustrate the operating states of the arrangement in FIG. 9, FIG. 11 show the perspective view of a buffering member.
Figure 10B:
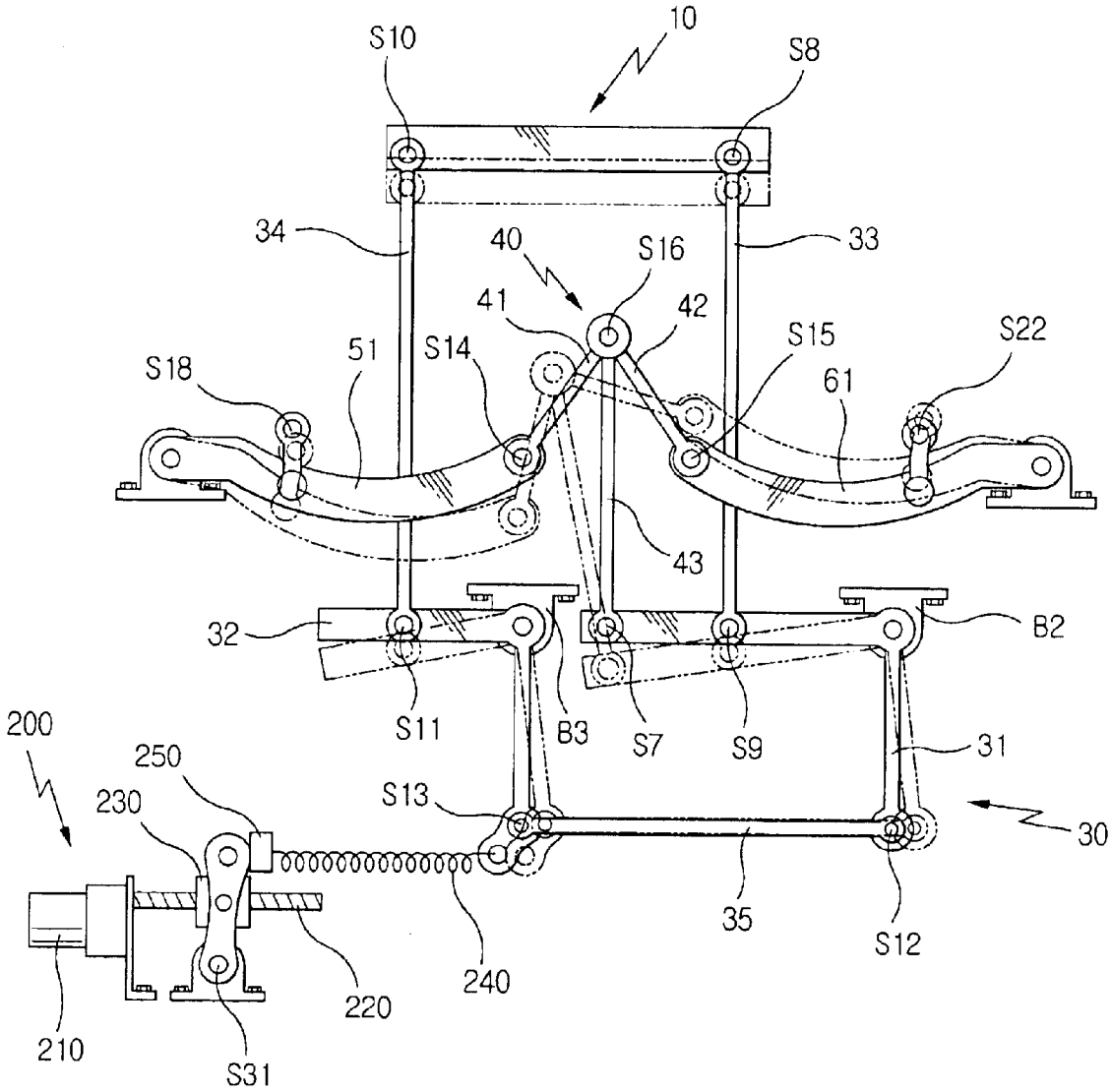

Referring to FIGS. 10*a* and 10*b*, lowering or moving the elevating rod 43 of the buffering member 40 down causes the axis S7 of the driving lever 31 concomitantly to fall to thereby turn the driving lever 31 anticlockwise about the bearings B2, as shown in the imaginary line, resulting in the forward movement of the axis S13 with the forward advance of the connecting rod 35, the latter being connected to the underside of the driving lever 31 via the axis S12, whereby the driven lever 32 is turned anticlockwise about the bearings B3, as shown in the imaginary line. Accordingly, the elevating rods 33 and 34 respectively connected to the driving and driven levers 31 and 32 via the axes S9 and S11 are lowered concurrently, with the result that the saddle support 10 connected to the elevating rods 33 and 34 via axes S8 and S10 is lowered, as shown in the imaginary line.

On the other hand, when the elevating rod 43 of the buffering member 40 is raised or moved upward in the same state as the above, the axis S7 of the driving lever 31 is simultaneously raised, and ultimately the elevating rods 33 and 34 connected to the driving and driven levers 31 and 32 via the axes S9 and S11 are raised in the reverse sequence of operation to the foregoing, so that the saddle support 10 supporting the saddle 2 is raised.

Therefore, the vertical reciprocal movement of the elevating rod 43 of the abovementioned buffering member 40 can produce the vertical reciprocal movement of the saddle support 10 owing to the elevating assembly 30, which operates in the same manner as described above.

Figure 11:
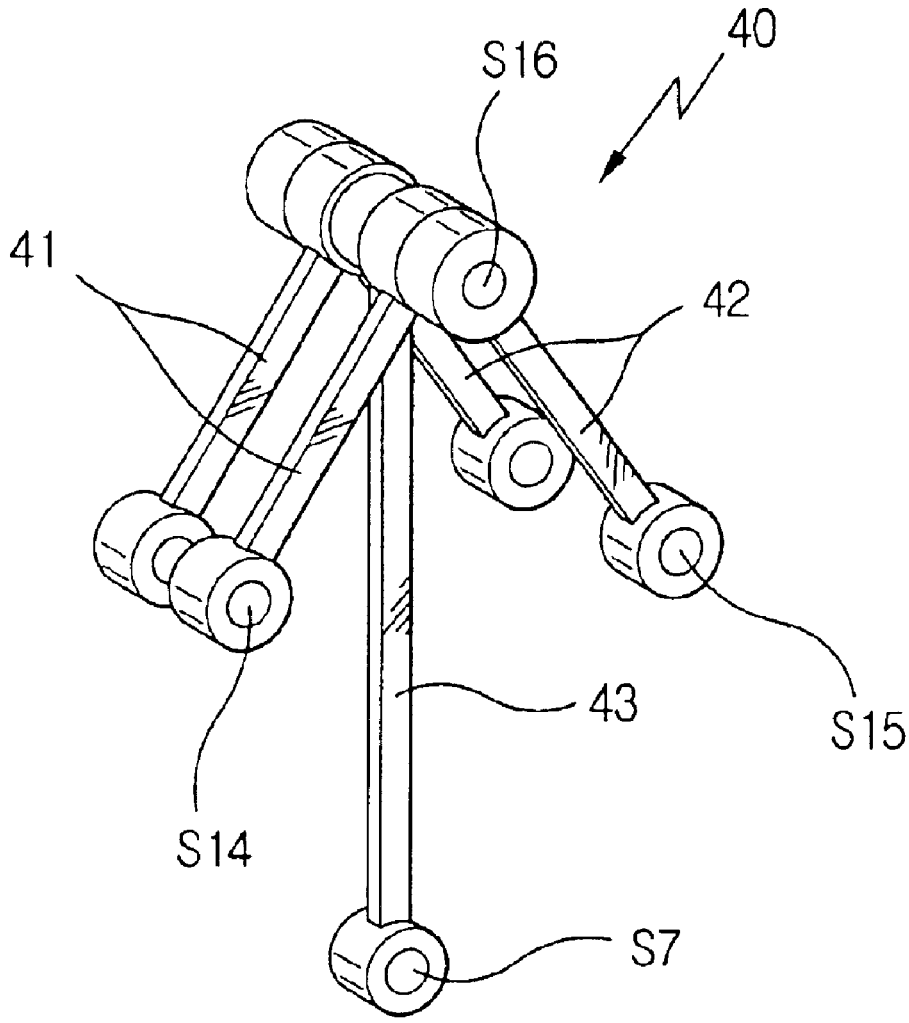

The buffering member 40 connected to the elevating assembly 30 serves to conduct the vertical reciprocal movement of the latter in a soft manner, wherein the buffering member 40 comprises, as shown in FIG. 11, a set of the first and second connecting levers 41 and 42, the bottoms of the levers being connected to the first and second working assemblies 50 and 60 via axes S14 and S15 respectively, and the respective top ends of the levers being associated with each other by an axis S16; and an elevating rod 43, the top and bottom of the rod being associated with the tops of the first and second connecting levers 41 and 42, and connected to the elevating assembly 30 via axis S16 and axis S7 respectively.

The first connecting levers 41 are composed of two component parts, wherein the top ends of the levers 41 are connected to top ends of the second connecting levers 42 and the elevating rod 43 by the axis S16, and the bottom ends of the levers 41 are connected to the first working levers 51 of the first working assembly 50 via the axis 14.

The second connecting levers 42 are composed of two component parts, wherein the top ends of the levers 42 are connected to top ends of the first connecting levers 41 and the elevating rod 43 by the axis S16, and the bottom ends of the levers 42 are connected to the second working levers 61 of the second working assembly 60 via the axis 15. The first and second working assemblies 50 and 60 are described in some more detail later.

The elevating rod 43, which may be composed of two component parts, is connected at its top with the top of the first and second connecting levers 41 and 42 via the axis S16 and at its bottom with the driving lever 31 of the elevating assembly 30 via the axis S7.

As indicated before, such a buffering member 40 acts to alleviate the vertical reciprocating motions of the first and second working assemblies 50 and 60 so as to be transmitted to the elevating member 30 softly, the operation of the buffering member being described in detail below in conjunction with that of the first and second working assemblies 50 and 60.

Figure 13:
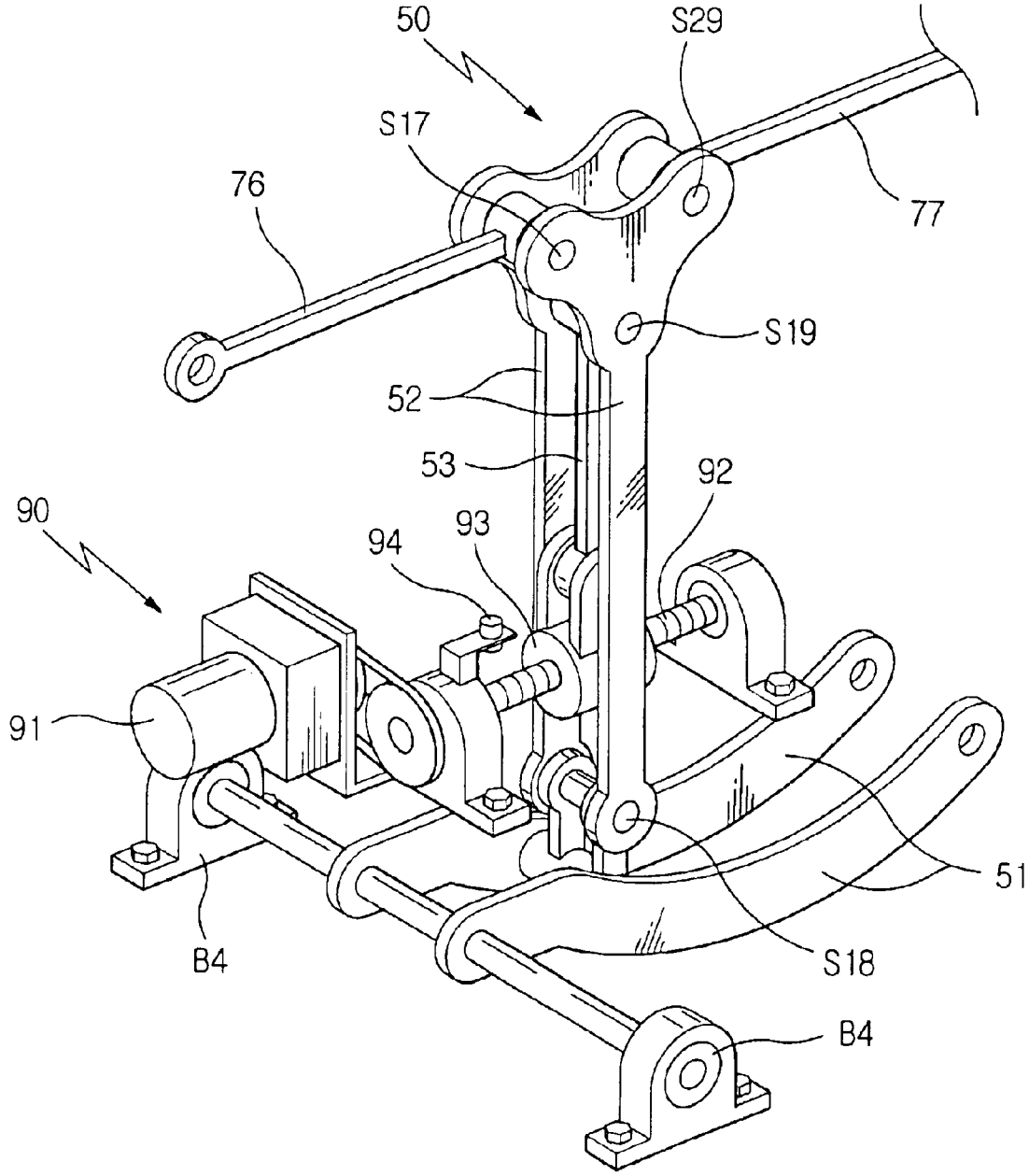

The first working assembly 50, which is disposed in the rear part of the frame 1 and intended to cause the vertical movement of the first connecting levers 41 of the buffering member 40, comprises, as shown in FIG. 13, the first working levers 51 fixed to the frame 1 via bearings B4 and connected to the buffering member 40 via an axis S14; the first elevating levers 52 connected, at their bottom and top, to the working levers 51 and to the driving assembly 70 via an axis S18 and S17; and the first adjusting rod 53 connected, at its top and bottom, to the first elevating levers 52 and to the first elevation adjusting assembly 90 via axes S19 and S20.

The first working levers 51 are composed of two component parts, wherein the rear ends of the levers 51 are rotatably fixed to the frame 1 via bearings B4 and the front ends of the levers 51 are connected to the first connecting levers 41 of the buffering member 40 via an axis 14.

The first elevating levers 52 are composed of two component parts, wherein the top ends of the levers 51 are located between the first link 76 and the second link 77 of the driving assembly 70, to be described later, and are connected to the first and second links 76 and 77 via axes S17 and S29, while the lower ends of the levers 52 are connected to the first working levers 51 via an axis S18.

The first adjusting rod 53 is arranged between the opposite first elevating levers 52, which are composed of two parts, wherein the top of the rod 53 is connected to the first elevating levers 52 via an axis S19, while the bottom part of the rod 53 is connected to the first adjusting nut 93 of the first elevation adjusting assembly 90, to be described later, via an axis S20.

Figure 15:
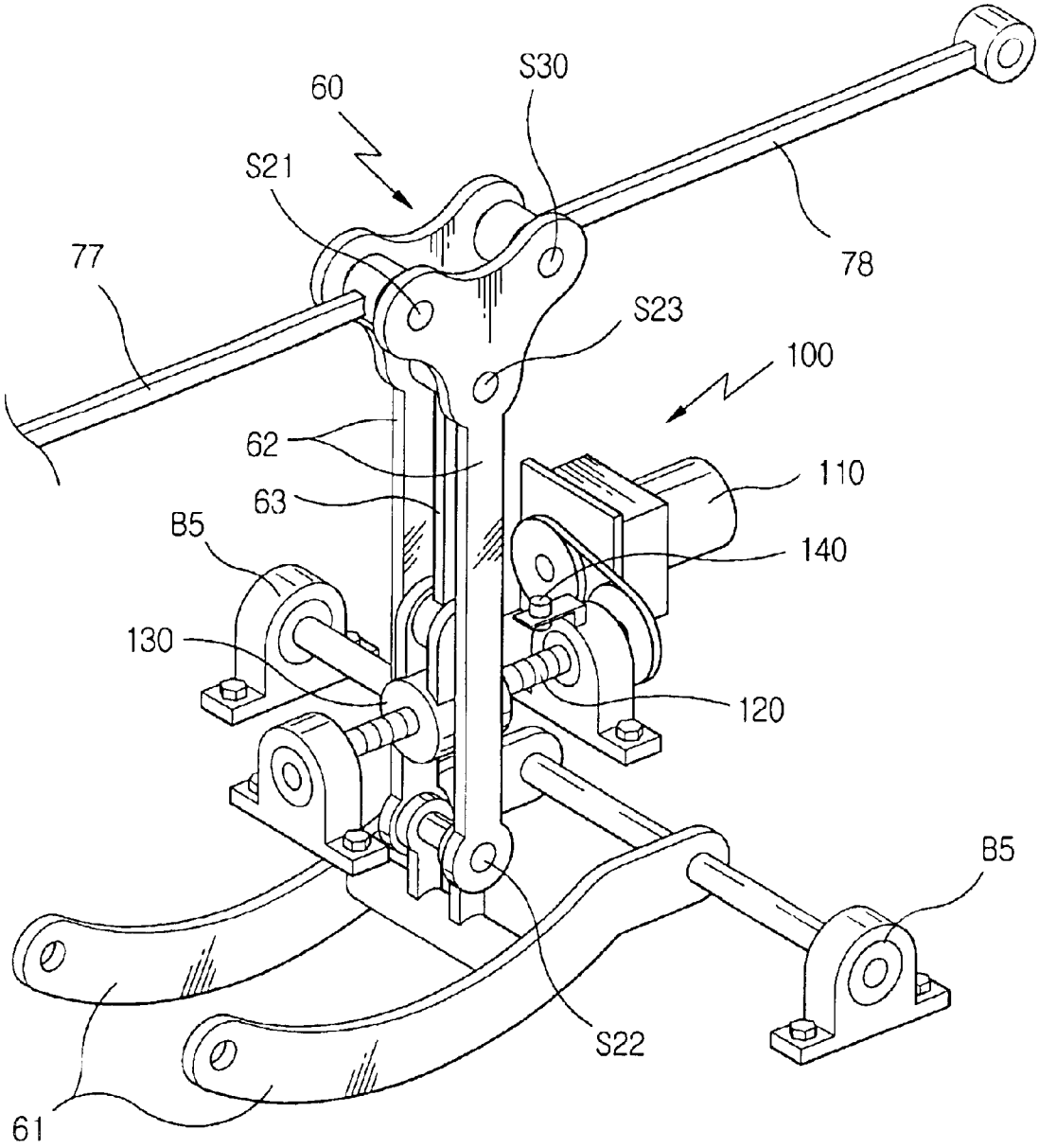

As shown in FIG. 15, the second working assembly 60, which is disposed in the rear part of the frame 1 and intended to cause the vertical movement of the second connecting levers 42 of the buffering member 40, comprises; the second working levers 61 fixed to the frame 1 via bearings B5 and connected to the buffering member 40 via an axis S15; the second elevating levers 62 connected, at their bottom and top, to the working levers 61 and to the driving assembly 70 via axis S22 and axis S21; and the second adjusting rod 63 connected, at its top and bottom, to the second elevating levers 62 and to the second elevation adjusting assembly 100 via axes S23 and S24. It is seen that the second components 60 and 100 shown in FIG. 15 are substantially a mirror image of the corresponding first components 50 and 90 shown in FIG. 13.

The second working levers 61 are composed of two component parts, wherein the front ends of the levers 61 are rotatably fixed to the frame 1 via bearings B5 and the rear ends of the levers 61 are connected to the second connecting levers 42 of the buffering member 40 via an axis 15.

The second elevating levers 62 are composed of two component parts, wherein the top ends of the levers 61 are located between the second link 77 and the third link 78 of the driving assembly 70, to be described later, and are connected to the second and third links 77 and 78 via axes S21 and S30, while the lower ends of the levers 62 are connected to the second working levers 61 via an axis S22.

The second adjusting rod 63 is arranged between the opposite second elevating levers 62, which are composed of two parts, wherein the top of the rod 63 is connected to the second elevating levers 62 via an axis S23, while the bottom part of the rod 63 is connected to the second adjusting nut 130 of the second elevation adjusting assembly 100, to be described later, via an axis S24.

The operations of the buffering member 40 and the first and second working assemblies 50 and 60, constructed as described in the above, are now described below.

Figure 14A:
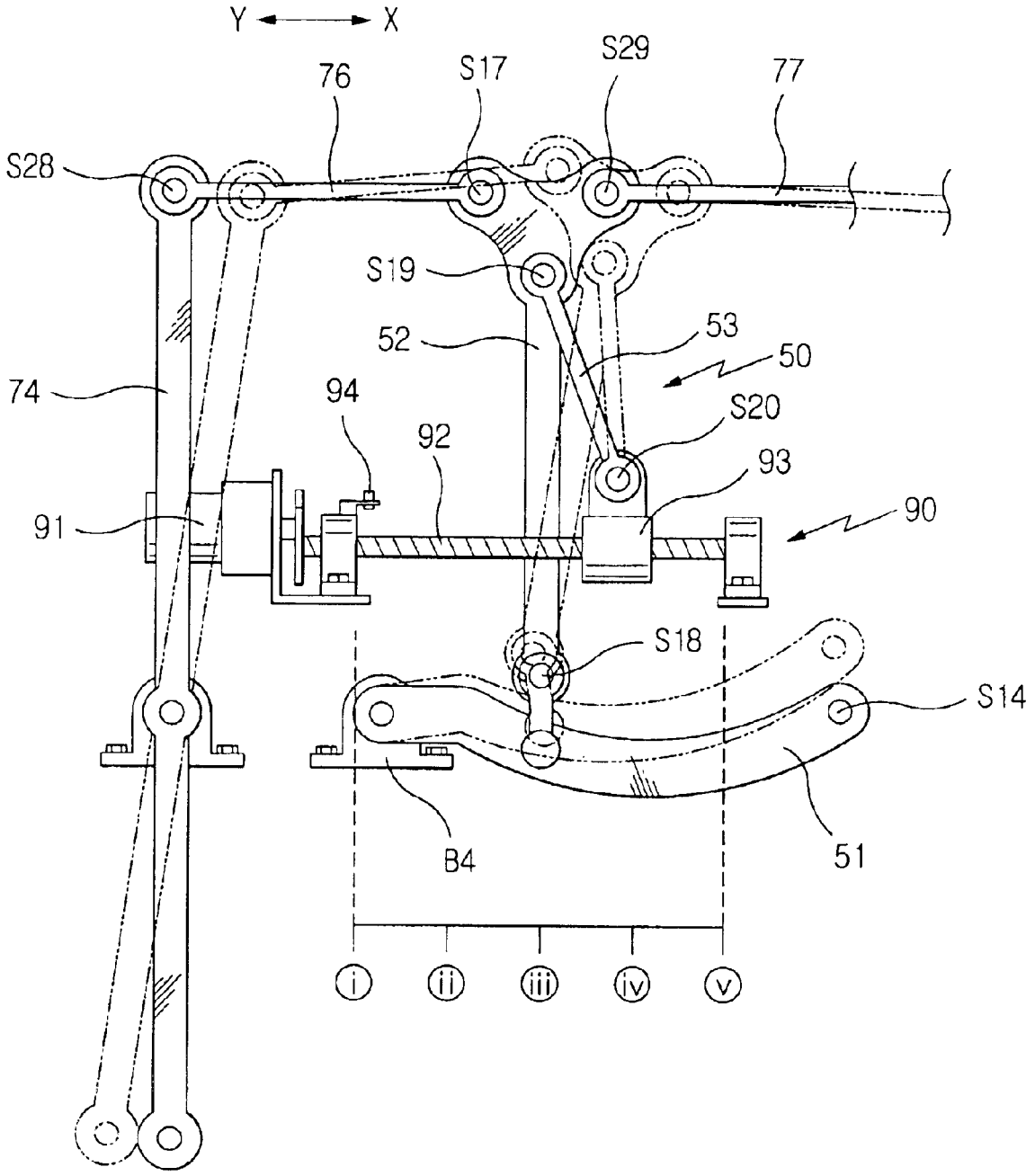
FIGS. 14*a* through 14*c* show the operating states of the arrangement in FIG. 13, FIG. 15 show the perspective view of the second working assembly and the second elevation adjusting arrangement.

Referring to FIG. 14*a* for the case of the first working assembly 50, when the first link 76 of the driving assembly 70 is pushed in the direction of X or moved forward, in the state that the axis S20 of the first adjusting rod 53 has been moved to the position iv by adjusting the first elevation adjusting assembly 90, the first elevating levers 52 are moved upward, as shown in the imaginary or dotted line. At this moment, because the axis S14 of the first working levers 51 is not allowed to move forward or backward but only allowed to turn about the bearings B4 as its axis, as shown in the drawing, so as to be raised or lowered, thus the axis S18 is raised, as shown in the imaginary line, simultaneously with the ascent of the first elevating levers 52. Thereby, the axis S14 of the first working levers 51 is moved upward, as shown in the imaginary line, so as to raise the first connecting levers 41 of the buffering member 40 as the result.

On the contrary, when the first link 76 is pulled in the Y direction in the same state as in the above, the axis S18 of the elevating levers 52 and the first working levers 51 is caused to move down, and concurrently the axis S14 of the first working levers 51 is moved downward, as shown in the solid line, to pull the first connecting levers 41 of the buffering member 40 down.

Accordingly, the horizontal reciprocal motion of the first link 76 of the driving assembly 70 can produce the vertical reciprocal motion through the simultaneous interlock of the first connecting levers 41 of the buffering member 40, with the aid of the first working assembly 50 operating as described above.

Here, when the axis 20 of the first adjusting rod 53 is located the closer to the point iv, then the distance of vertical movement for the axis S14 relative to the given horizontal stoke of the first link 76 gets the larger.

Figure 14B:
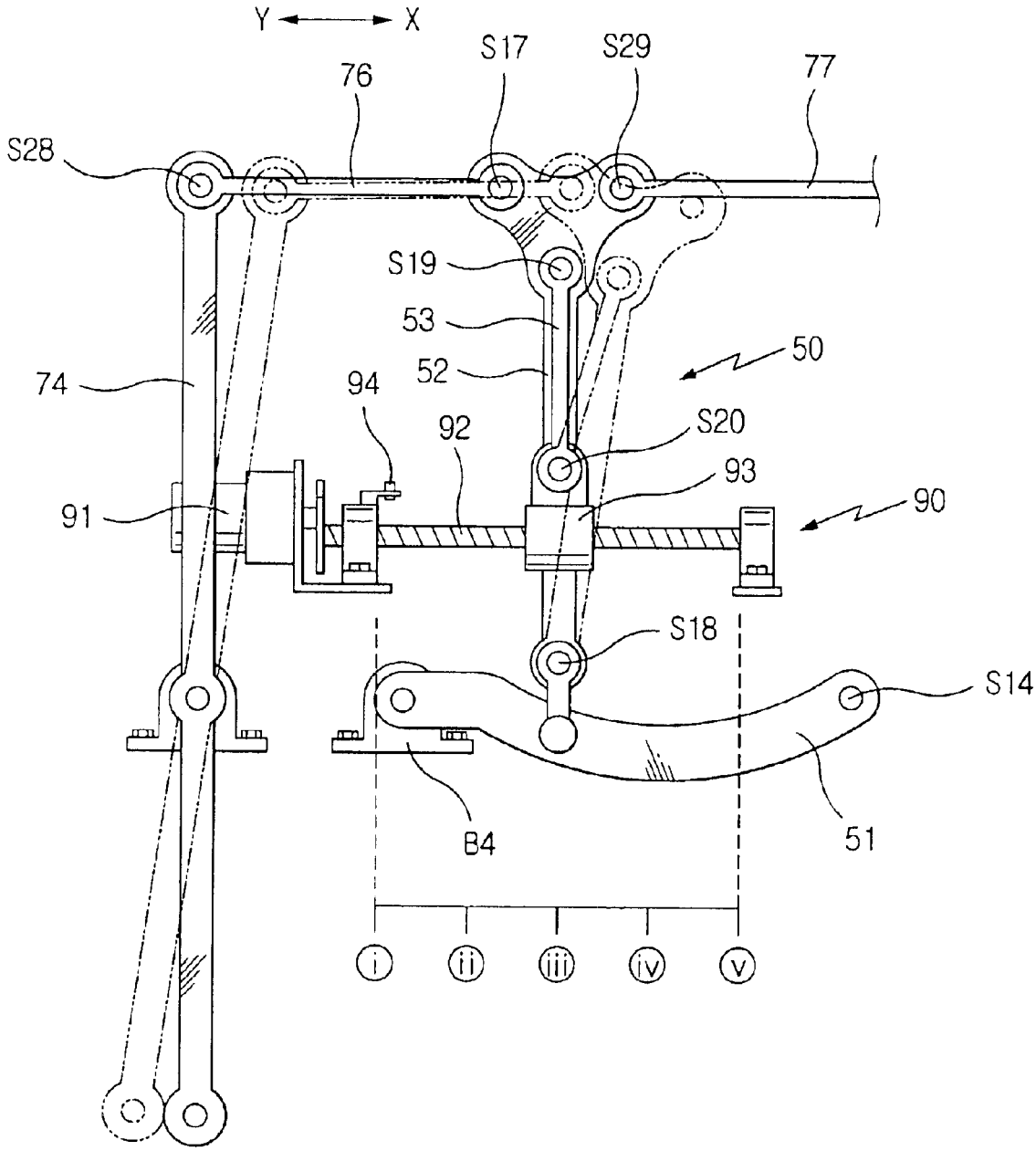

In addition, as shown in FIG. 14*b*, when the axis S20 of the adjusting rod 53 is adjusted to position at the middle point ii, the elevating levers 52 make a negligible vertical displacement.

Figure 14C:
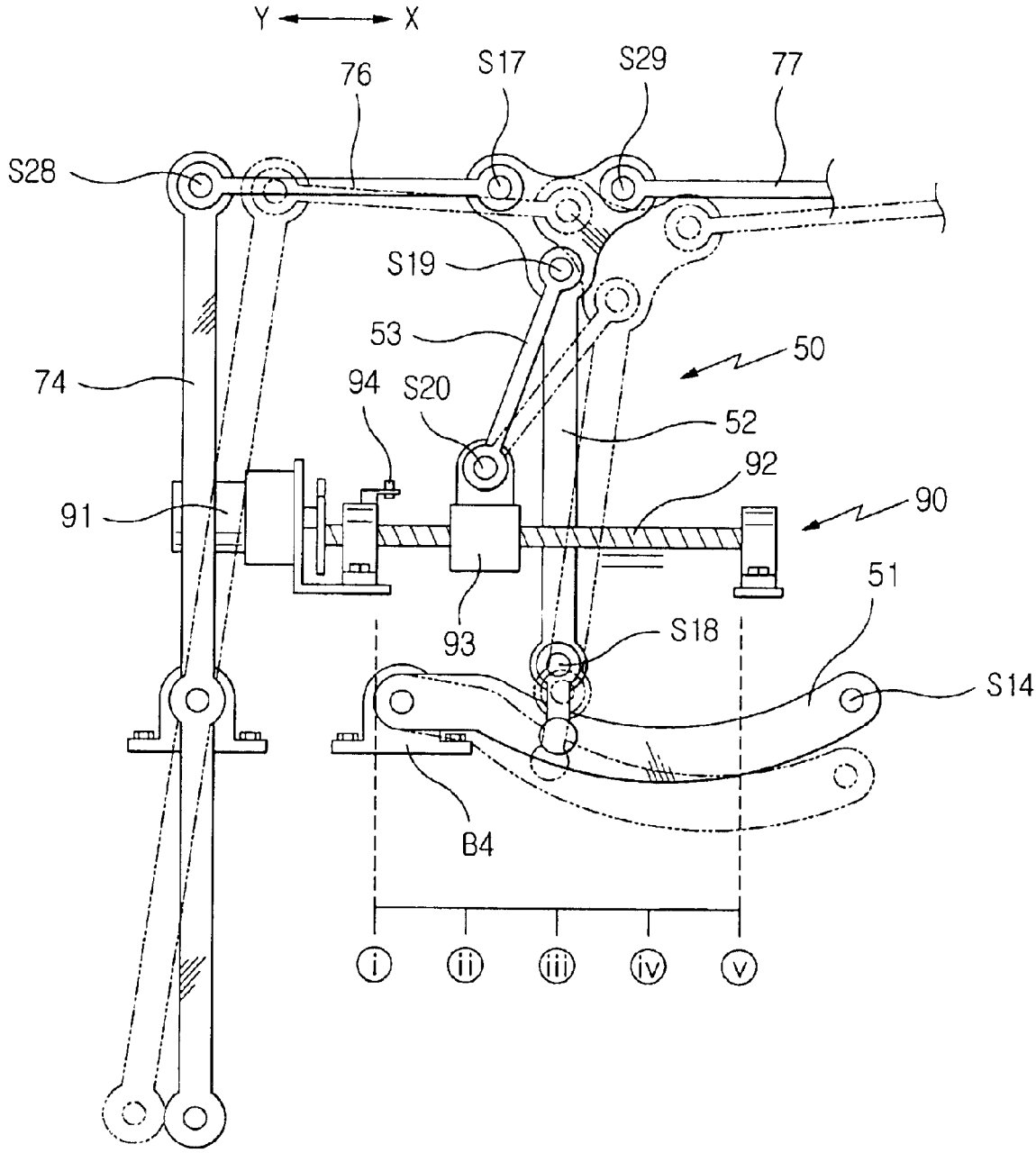

On the other hand, when the first link 76 of the driving assembly 70 is pushed in the X direction, with the axis S20 of the first adjusting rod 53 or the nut 93 adjusted at the rearward point ii, as shown in FIG. 14*c*, the axis S18 of the first elevating levers 52 and the first working levers 51 is caused to move down, and at the same time, the axis S14 of the first working levers 51 is moved down, as shown in the imaginary line, to pull the first connecting levers 41 of the buffering member 40 down.

On the contrary, when the first link 76 is pulled in the Y direction, the axis S18 of the first elevating levers 52 and the first working levers 51 is caused to move up, and concurrently the axis S14 of the first working levers 51 is moved up, as shown in the solid line, to pull the first connecting levers 41 of the buffering member 40 up.

Here, the closer the axis 20 of the first adjusting rod 53 is located to the point i, the larger becomes the distance of vertical movement for the axis S14 relative to the given horizontal stoke of the first link 76.

Figure 16A:
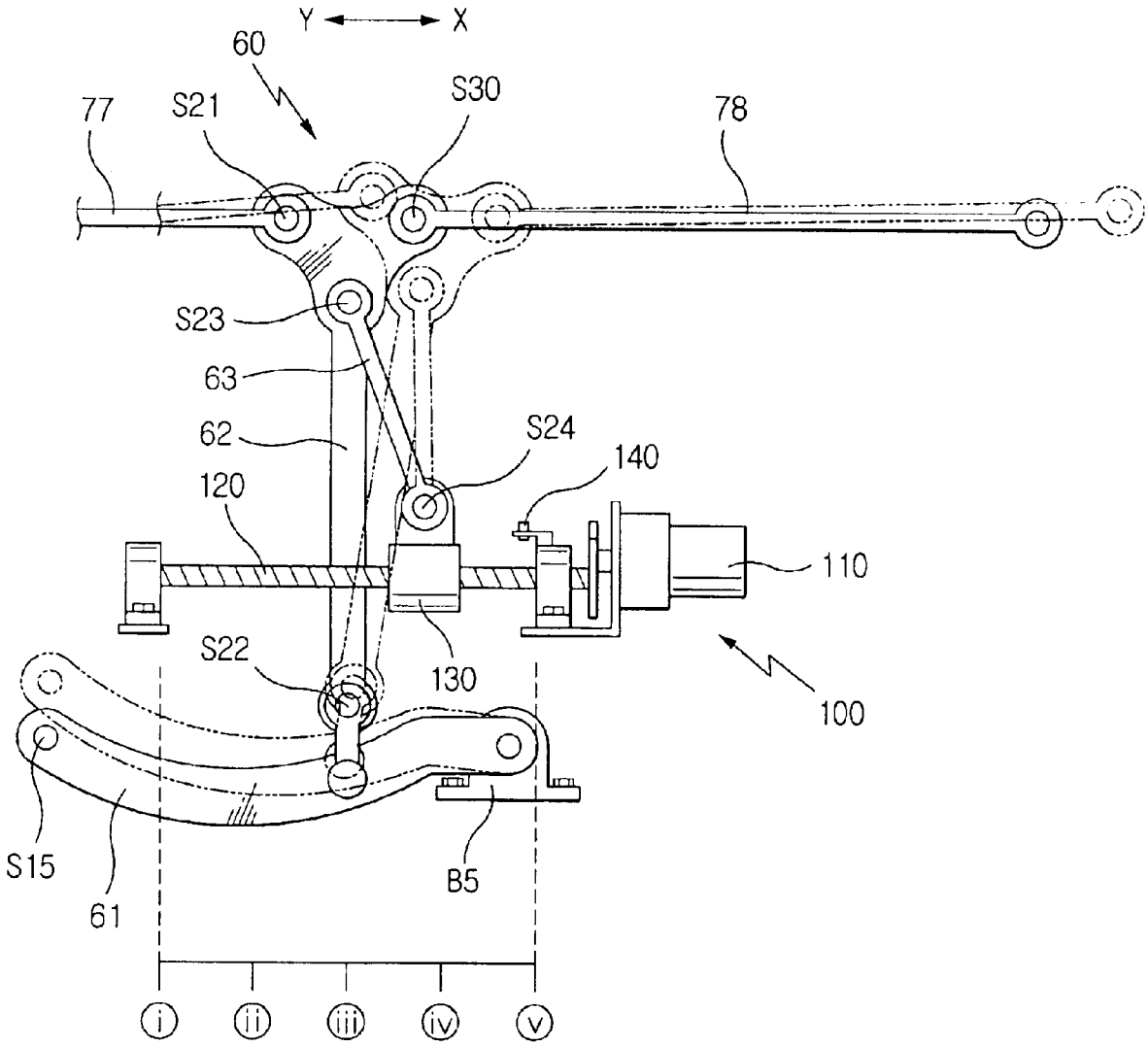
FIGS. 16*a* through 16*c* show the operating states of the arrangement in FIG. 15.

Referring to FIG. 16*a* in connection with the operation of the second working assembly 60, when the second link 77 of the driving assembly 70 is pushed in the X direction or moved forward, in the state that the axis S24 of the second adjusting rod 63 has been moved to the position iv, by adjusting the second elevation adjusting assembly 100, the second elevating levers 62 are moved upward, as shown in the imaginary line. Consequently, because the axis S15 of the second working levers 61 is not allowed to move horizontally, but only allowed to turn about the bearings B5 as its axis, as shown in the drawing, so as to be moved up and down, thus the axis S22 is raised in this case, as shown in the imaginary line, simultaneously with the ascent of the second elevating levers 62. Thereby, the axis S15 of the second working levers 62 is moved upward, as shown in the imaginary line, so as to raise the second connecting levers 42 of the buffering member 40.

On the contrary, when the second link 77 is pulled in the Y direction in the same state as in the above, the axis S22 of the elevating levers 62 and the second working levers 61 is caused to move down, and concurrently the axis S15 of the second working levers 61 is moved downward, as shown in the solid line, to pull the second connecting levers 42 of the buffering member 40 down.

Accordingly, the horizontal reciprocal motion of the second link 77 of the driving assembly 70 can produce the vertical reciprocal motion through the operation of the second connecting levers 42 of the buffering member 40, with the aid of the second working assembly 60, all components operating as described above.

Here, when the axis 24 of the second adjusting rod 63 is located closer to the point iv, then the distance of vertical movement for the axis S15 relative to the given horizontal stoke of the first link 77 gets the larger.

Figure 16B:
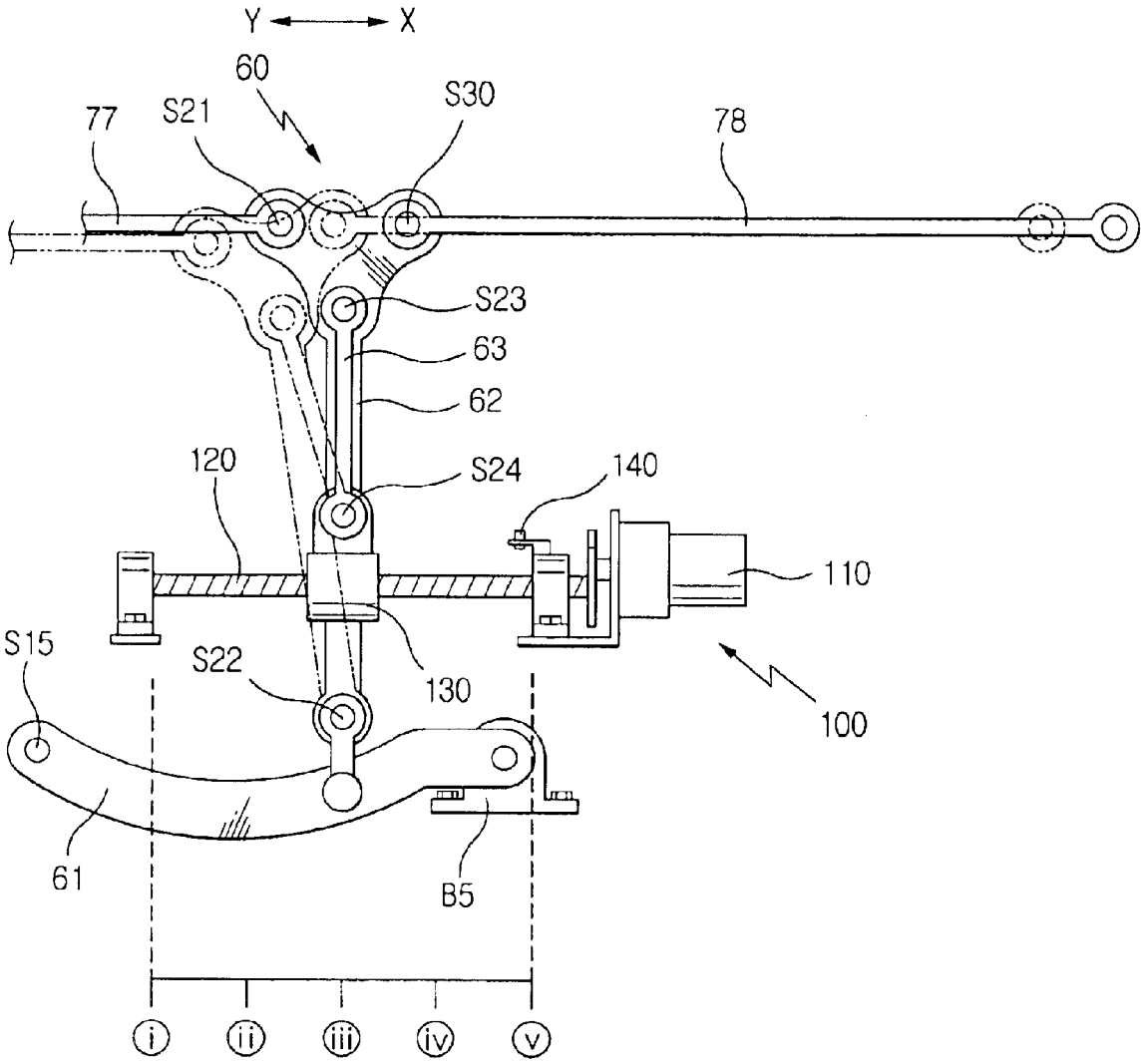

However, as shown in FIG. 16*b*, when the axis S24 of the adjusting rod 63 is adjusted to position at the middle point iii, the elevating levers 62 make a negligible vertical displacement.

Figure 16C:
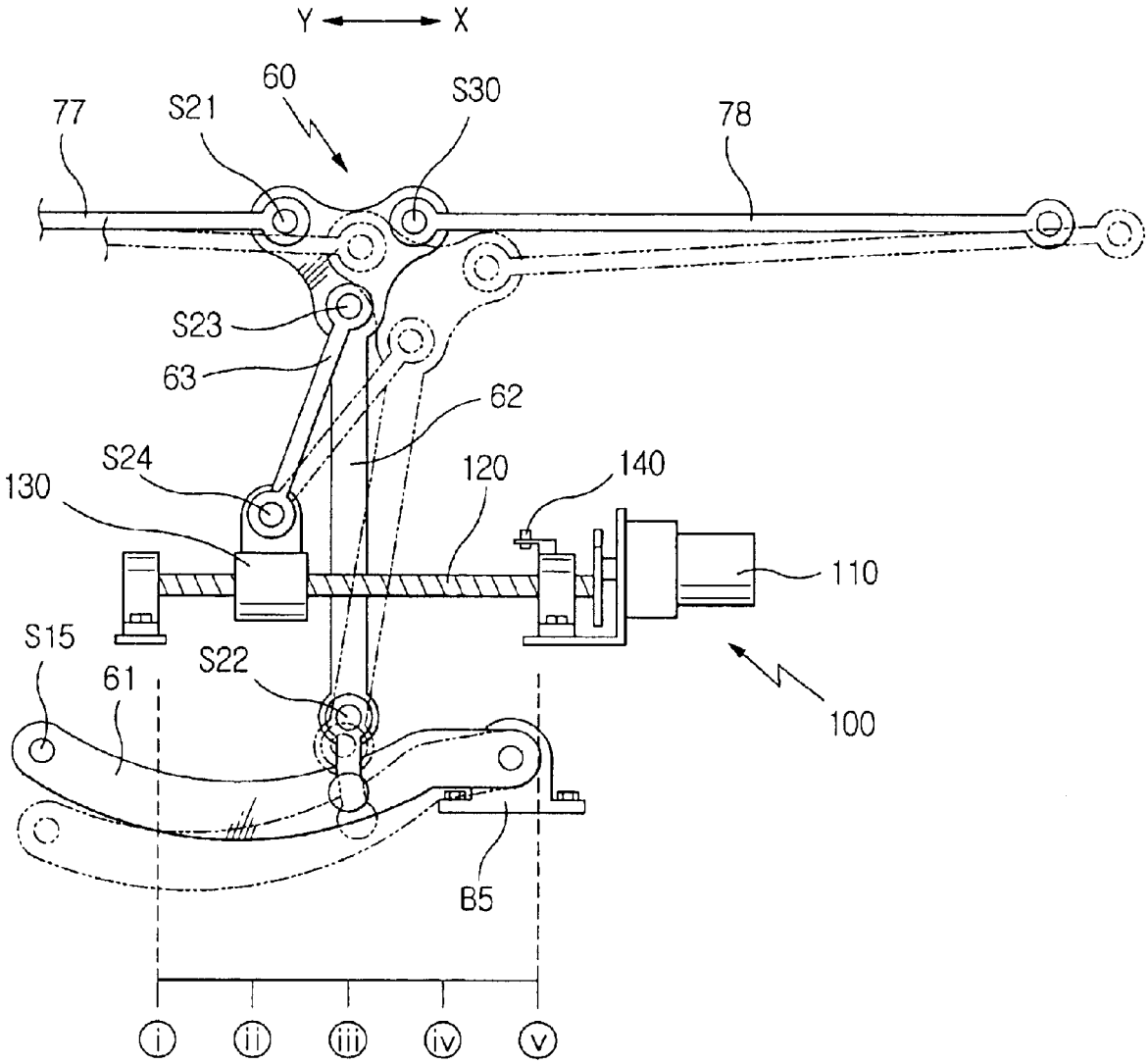
Figure 17:
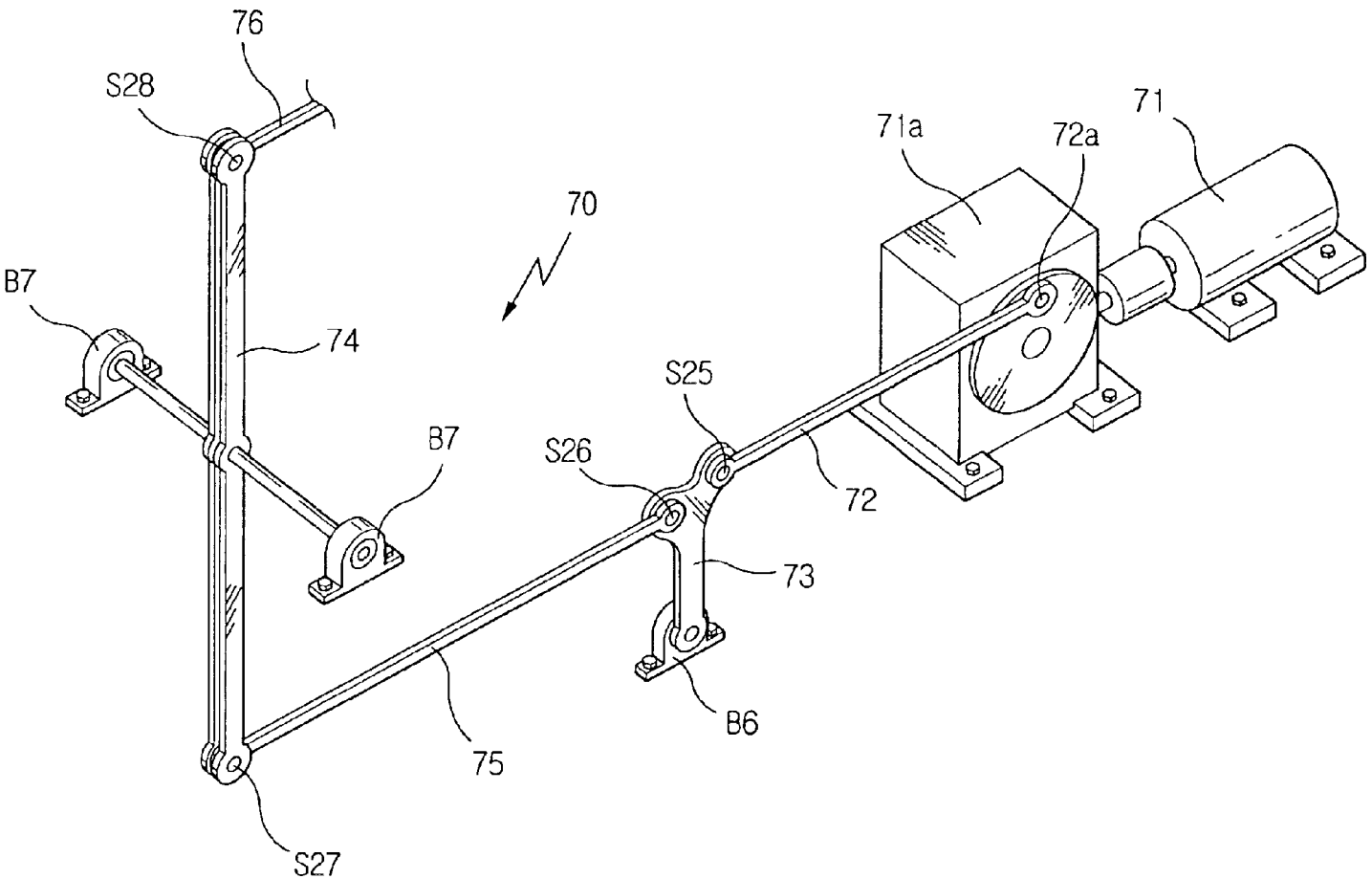
FIG. 17 shows the perspective view of a driving assembly.

On the other hand, when the second link 77 of the driving assembly 70 is pushed in the X direction, with the axis S24 of the second adjusting rod 63 or the nut 130 adjusted at the rearward point ii as shown in FIG. 16*c*, the axis S22 of the second elevating levers 62 and the first working levers 61 is caused to move down, and at the same time, the axis S15 of the second working levers 61 is moved down to pull the second connecting levers 42 of the buffering member 40 down.

On the contrary, when the second link 77 is pulled in the Y direction, the axis S22 of the second elevating levers 62 and the second working levers 61 is caused to move up, and concurrently the axis S15 of the second working levers 61 is moved up to pull the second connecting levers 42 of the buffering member 40 up.

Here, the closer the axis 24 of the second adjusting rod 63 is located to the point i, the larger becomes the distance of vertical movement for the axis S15 per a given horizontal stoke of the second link 77.

Now, the operation of the buffering member 40, which acts to transfer the vertical reciprocating movement of the first and second working assemblies 50 and 60 constructed as in the above to the elevating assembly 30 after buffering the movement, is described.

Figure 12A:
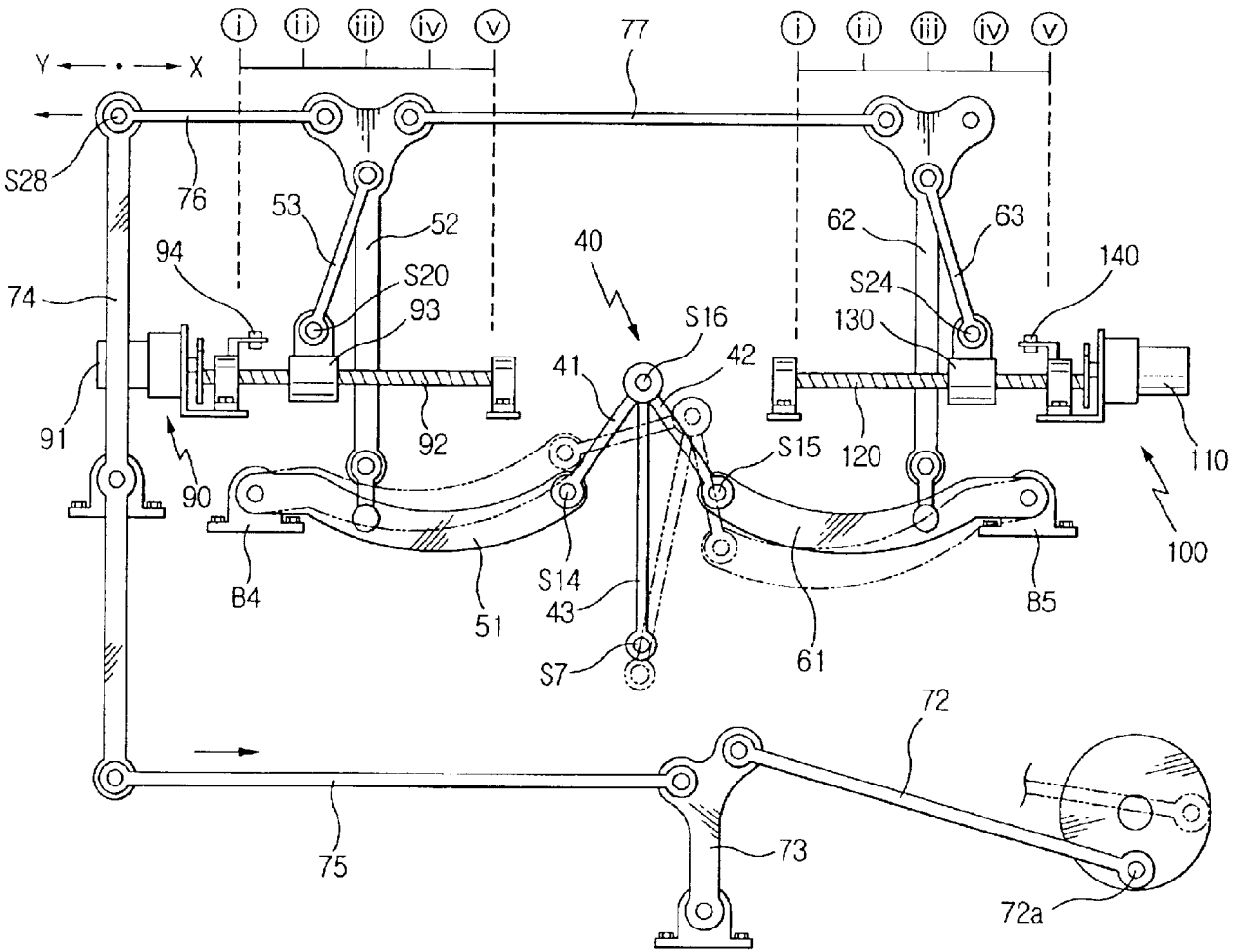
FIGS. 12*a* through 12*c* illustrate the operating states of the arrangement including the member in FIG. 11, FIG. 13 show the perspective view of the first working assembly and the first elevation adjusting arrangement.

When the second link 77 and first link 76 of the driving assembly 70 are pushed forward, with the axis S24 of the second working assembly 60 and the axis S20 of the first working assembly 50 being respectively moved to the positions, as depicted in FIG. 12*a*, the second connecting levers 42 are moved upward due to the ascending axis S15, and at the same time, the first connecting levers 41 are moved down due to the descending axis S14, with the combined result that the elevating rod 43 of the buffering member 40 is raised as in the solid line in the drawing.

In the same state as in the above, when the second link 77 and first link 76 of the driving assembly 70 are pushed rearward or in Y direction, on the contrary, a reverse operation takes place, resulting in the descent of the rod 43 as shown in the dotted line.

Thus, the horizontal reciprocation of the second link 77 and first link 76 of the driving assembly 70 causes the resultant vertical reciprocation of the elevating rod 43 of the buffering member 40, which is transferred to the driving lever 31 of the elevating assembly 30 via the axis S7.

Figure 12B:
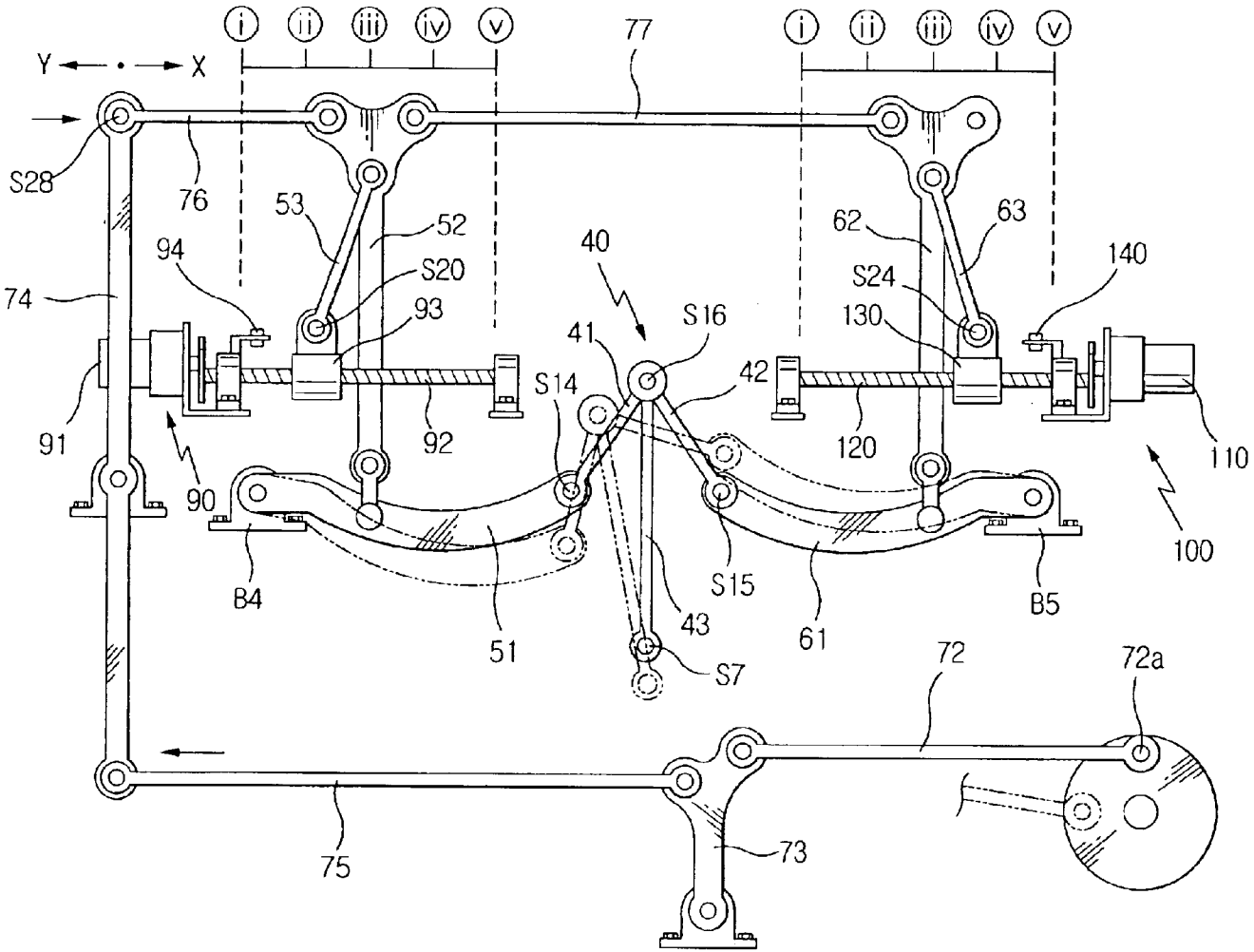

In FIG. 12*b*, the axis S24 of the second working assembly 60 and the axis S20 of the first working assembly 50 are placed at the same position as in FIG. 12*a*. However, it may show that different states of operation can take place depending on the degree and direction of movement of the axis S28 and/or practical designs concerning the relative dimensions and arrangements of relevant components. Now referring to the diagram as shown in FIG. 12*b*, when the second link 77 and first link 76 of the driving assembly 70 are pushed forward, i.e. in the X direction in this state, the second connecting levers 42 are moved up concurrently with the ascending axis S15 and the connecting levers 41 are moved down concurrently with the descending axis S14, resulting in the descent of the elevating lever 43, as shown in the imaginary line.

Reversely to the above, when the second link 77 and first link 76 of the driving assembly 70 are pulled in the Y direction in the same state as in FIG. 12*b*, the reverse operation would take place, that is, the resultant ascent of the elevating lever 43, as shown in the solid line.

It is seen that the resultant operation in the case of FIG. 12*b* is reverse to that in the case of FIG. 12*a* or symmetric to each other, due to the mirror symmetric constructions between the first and second working assemblies 50 and 60.

Figure 12C:
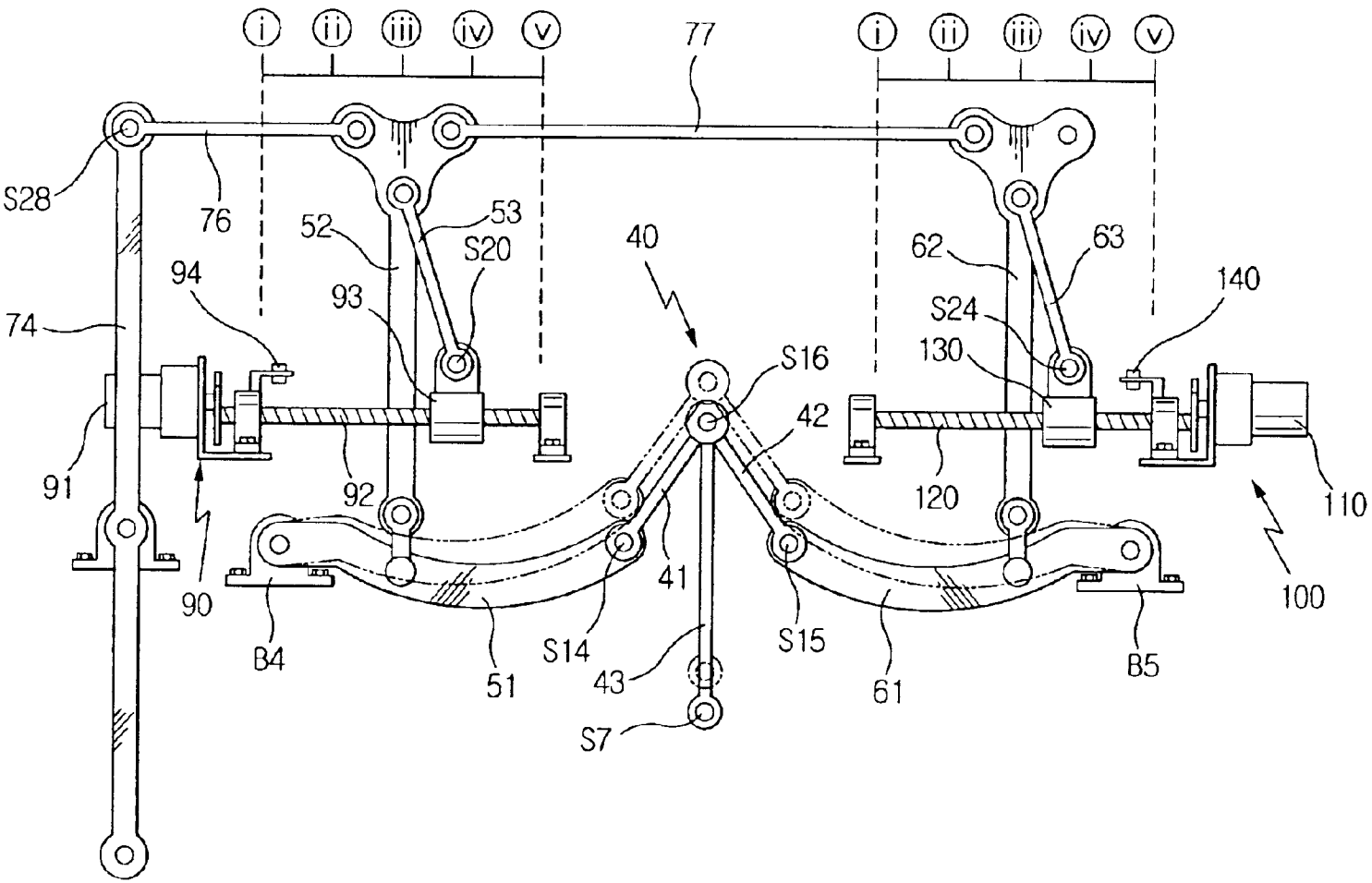

Here, the combination of other positionings of the first and second adjusting nuts 93 and 130 for the first and second working assemblies 50 and 60 rather than the positionings illustrated in FIGS. 12*a* through 12*c* as examples, let alone the different principal designs of the paired arrangements, may be chosen, as desired, so that the more various movements of the buffering member 40 including the elevating rod 43 may result. Given a specific case, if the directions of vertical movements for the axes S15 and S14 for the second and first working levers 61 and 51 are reverse to each other, the corresponding vertical movement of the axis S7 would be small, while the vertical movement of the axis S7 would be large when the abovementioned directions are the same.

The above described driving assembly 70 acts to drive both the sliding assembly 20 and the first and second working assemblies 50 and 60, wherein the assembly 70 comprises, as shown in FIGS. 2, 3 and 4 and FIG. 17, a driving motor 71 electrically connected to the controller 300 and equipped with a speed reducer 71*a*; a crank 72 connected to the speed reducer 71*a* through an eccentric shaft 72*a*; a connecting arm 73 connected to the crank 72 through an axis S25 and fixed, at its bottom, to the frame 1 through a bearing B6; a driving lever 74 fixed, at its middle point, to the rear point of the frame 1 through bearings B7; a connecting rod 75 connected, at its opposite ends, to the connecting arm 73 and to the bottom of the driving lever 74 through axes S26 and S27; and a first, second and third links 76, 77 and 78 for being moved forward and backward by the driving lever 74 and for operating both the sliding assembly 20 and the first and second working assemblies 50 and 60.

The above described driving motor 71 is electrically connected to the controller 300 and equipped with a speed reducer 71*a*, wherein the motor 71 and the speed reducer 71*a* are firmly fixed to the frame 1.

The crank 72 is connected eccentrically to the speed reducer 71*a* for driving the connecting arm 73, wherein the front end of the crank 72 is connected to the reducer 71*a* via the eccentric shaft 72*a* and the rear end of the crank 72 is connected to the connecting arm 73 via the axis S25.

The connecting arm 73, composed of two parts, is rotatably fixed, at its bottom, to a frame 1 through a bearing B6, wherein the arm 73 is positioned between the crank 72 and the connecting rod 75 and at its upper opposite ends, connected to the rear end of the crank 72 and the front end of the connecting rod 75 through axes S25 and S26 respectively.

The driving lever 74, composed of two parts, is rotatably fixed to the frame 1 through bearings B7 at the middle point of the lever 74, wherein the bottom of the lever 74 is connected to the rear end of the connecting rod 75 through an axis S27 and the top of the lever 74 is connected to the rear end of the first link 76 through an axis S26.

The connecting rod 75 acts to transfer the driving power of the connecting arm 73 to the driving lever 74 and is connected, at its front end, to the connecting arm 73 via the axis S26 and at its rear end, to the bottom of the driving lever 74 via the axis S27.

The first link 76 is positioned between the driving lever 74 and the elevating levers 52 of the first working assembly 50 to convey the driving force of the driving lever 74 to the elevating levers 52, wherein the opposite ends of the link 76 are connected to the top of the driving lever 74 and the first elevating levers 52 of the first working assembly 50 through the axes S28 and S17.

The second link 77 is positioned between the first elevating levers 52 of the first working assembly 50 and the second elevating levers 62 of the second working assembly 60 to convey the driving force of the first elevating levers 52 to the second elevating levers 62, wherein the opposite ends of the link 77 are connected to the first elevating levers 52 of the first working assembly 50 and the second elevating levers 62 of the second working assembly 60 through the axes S29 and S21.

The third link 78 is positioned between the second elevating levers 62 of the second working assembly 60 and the elevating levers 23 of the sliding assembly 20 to convey the driving force of the second elevating levers 62 to the elevating levers 23, wherein the opposite ends of the link 78 are connected to the second elevating levers 62 and the elevating levers 23 of the sliding assembly 20 through the axes S30 and S3.

The operation of the driving assembly 70 constructed as described above is now described.

Figure 5:
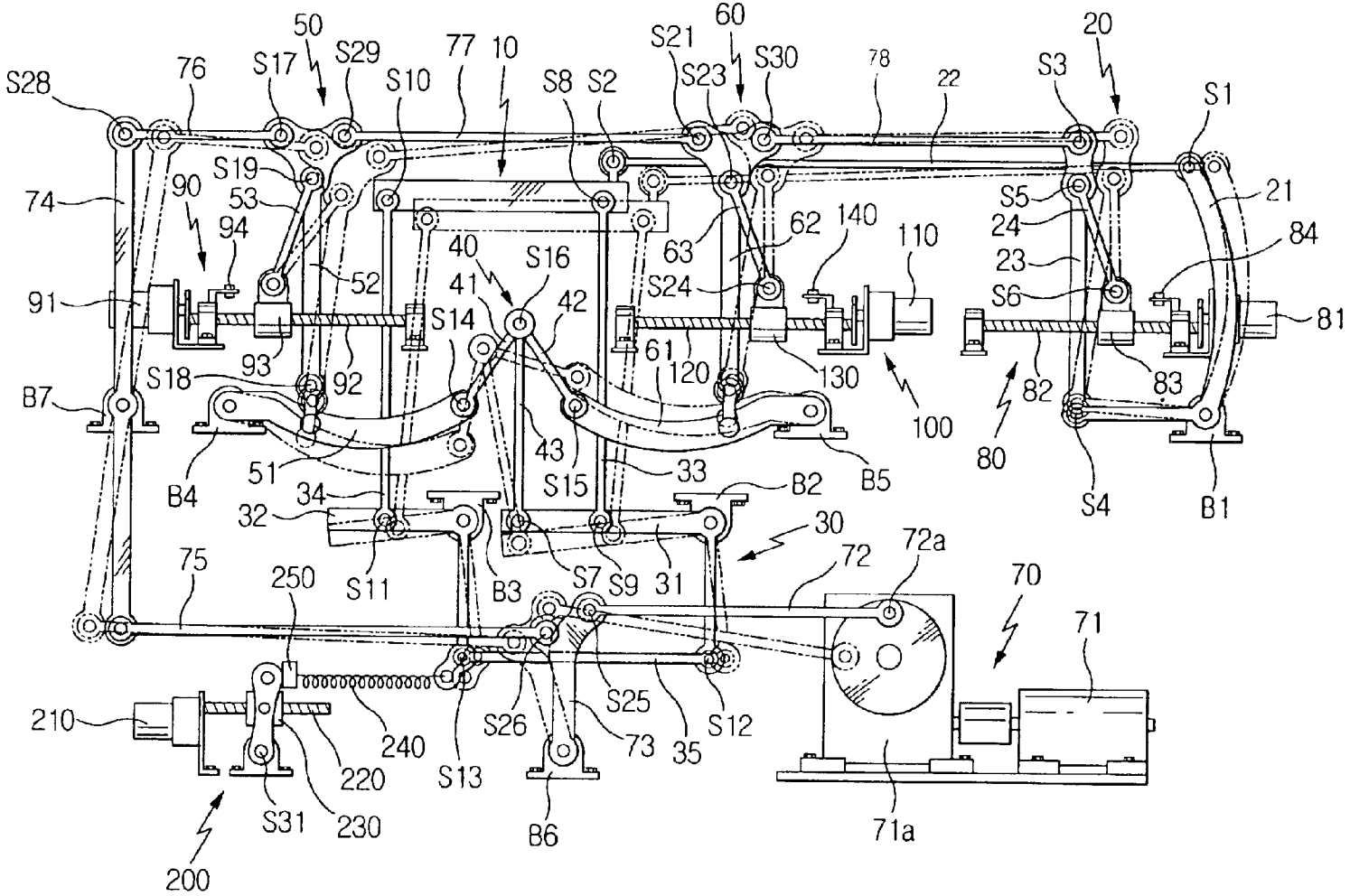
FIGS. 5 and 6 show the illustrative view of the invention, illustrating various operating states.
Figure 6:
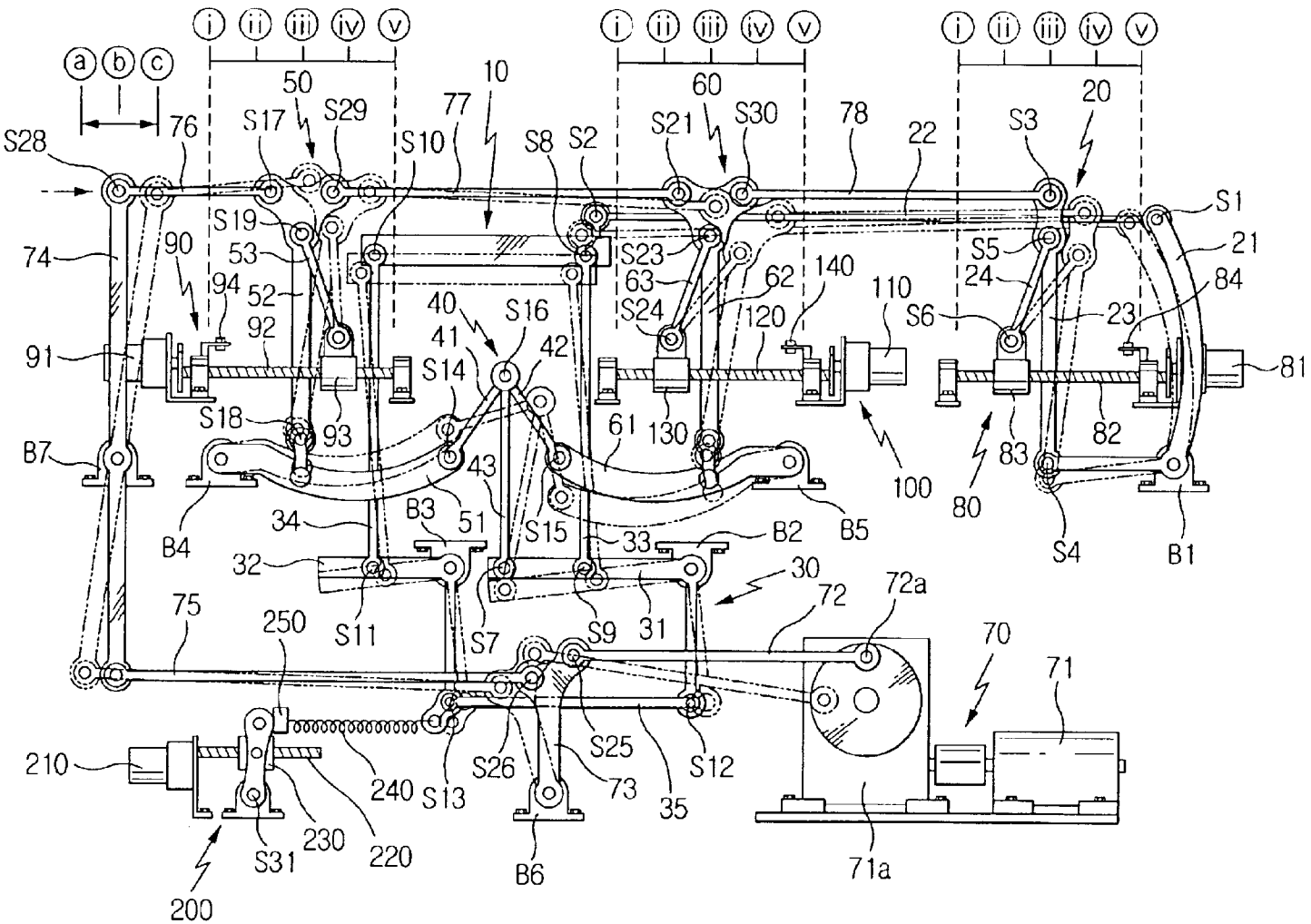

Referring FIGS. 5 and 6, when the driving motor 71 is driven by means of the controller 300, the crank 72 is caused to reciprocate back and forth as the eccentric shaft 72*a* connected eccentrically to the speed reducing device 71*a* is driven, and simultaneously the crank 72 and the axis S25 connected to the connecting arm 73 drive the latter, and then the connecting arm 73 conducts reciprocal rotation about the bearing B6 as its axis or rotation center, pushing and pulling the axis S26, with the result that the connecting rod 75 is moved horizontally.

Hereupon, the pushing and pulling speed of the crank 72 and the connecting rod 75 by the reducer 71*a* over the rotation of 360° would be about the same in the case of the integral form of the crank 72 with the connecting rod 75. However, in the present invention, the crank 72 and the connecting rod 75 are separately connected to the connecting arm 73 via the axis S25 and S26 respectively. Therefore, the crank 72 and the connecting arm 73 push and pull the connecting rod 75, drawing an approximate ellipse, whereby the stroke distance of the connecting rod 75 is decreased by about 20% as compared to the case of the above integral form. In addition, because the rotation speeds and stroke distances for the driving motor 71, reducer 71*a*, crank 72 and connecting arm 73 would not agree with one another, so that ultimately a soft driving force capable of producing the horse riding motions simulating the pace, rhythm and sensation of a horse can be obtained.

Further, the substantial horizontal reciprocation of the connecting rod 75 causes the driving lever 74 to swing or move back and forth about the bearings B7 as axes, whereby concurrently the first, second and third links 76, 77 and 78 cause the horizontal reciprocal movements of the first and second elevating levers 52 and 62 and the elevating levers 23.

Regarding the driving course, the driving force is from the driving motor 71 through the reducer 71*a*, crank 72, connecting arm 73, connecting rod 75 and driving lever 74, in that order, transferred to the first, second and third links 76, 77 and 78 to cause the latter members to conduct horizontal reciprocal movements, which movements are transferred to the first and second elevating levers 52 and 62 as well as the elevating levers 23 to move those levers forward and backward to thereby derive finally the vertical or horizontal movements of the saddle support 10, to be described later.

The above described distance adjusting assembly 80 acts to adjust the distance of horizontal reciprocation for the sliding assembly 20, wherein the adjusting assembly 80 comprises, as shown in FIG. 7 and FIGS. 8*a*, 8*b* and 8*c*, a motor 81 operating in a positive negative mode and electrically connected to a controller 300; a screw bar 82 connected to the motor 81; an adjusting nut 83 screwed on the screw bar 82 for horizontal movement; and a sensor 84 for detecting the position of the adjusting nut 83 and electrically connected to the controller 300.

The motor 81 electrically connected to a controller 300 is operated in a regular reverse mode and is fixed firmly to the frame 1.

The screw bar 82 acts to position the adjusting nut 83 longitudinally on its length, wherein the bar 82 is rotatably fixed to the frame 1 via a bearings and connected to the motor 81 through a chain and sprocket.

The adjusting nut 83 screw connected on the screw bar 82 serves to move the axis S6 of the adjusting rod 24 laterally, wherein the adjusting nut 83 is connected to the adjusting rod 24 through the axis S6.

The sensor 84 connected electrically to the controller 300 can detect the position of the adjusting nut 83, wherein the sensor 84 announces the position of the adjusting nut 83 through the controller 300.

The operation of the distance adjusting assembly 80 constructed as above is described below.

First, when the motor 81 of the distance adjusting assembly 80 is driven in the positive direction by the controller 300, simultaneously the screw bar 82 connected with the chain and sprocket is moved rightward so as to move the axis S6 of the adjusting rod 24 forward simultaneously.

Here, the adjusting nut 83 is able to be moved forward or backward for a new adjustment by driving the motor 81, even when the elevating levers 23 are in a vertical reciprocating motion, wherein the equipment user can control the position of the adjusting nut 83 automatically by using the controller 300 based on the position of the adjusting nut 83 detected by the sensor 84.

When the motor 81 of the distance adjusting assembly 80 is driven in the negative direction by the controller 300, simultaneously the screw bar 82 connected with the chain and sprocket is moved leftward so as to move the axis S6 of the adjusting rod 24 rearward simultaneously.

Thus, the axis S6 of the adjusting rod 24 can be adjusted or set forwardly or rearwardly at a desired position by adjusting the distance adjusting assembly 80 by means of the controller 300.

The above described first elevation adjusting assembly 90 serves to adjust the vertically reciprocating elevation of the first working assembly 50, wherein the elevation adjusting assembly 90 comprises, as shown in FIGS. 13, 14*a*, 14*b* and 14*c*, a first motor 91 operating in a positive negative mode and electrically connected to a controller 300; a first screw bar 92 connected to the first motor 91; a first adjusting nut 93 screw engaged on the first screw bar 92 for longitudinal movement; and a first sensor 94 for detecting the position of the first adjusting nut 93, the sensor being electrically connected to the controller 300.

The motor 91 electrically connected to a controller 300 is operated in a regular reverse mode and is fixed firmly to the frame 1.

The first screw bar 92 acts to position the first adjusting nut 93 longitudinally on its length, wherein the bar 92 is rotatably fixed to the frame 1 via bearings and connected to the motor 91 through chain and sprocket.

The adjusting nut 93 screw connected on the first screw bar 92 serves to move the axis S20 of the first adjusting rod 53 laterally, wherein the adjusting nut 93 is connected to the first adjusting rod 53 through the axis S20.

The sensor 94 connected electrically to the controller 300 detects the position of the first adjusting nut 93, wherein the sensor 94 announces the position of the adjusting nut 93 through the controller 300.

The operation of the first elevation adjusting assembly 90 constructed as above is described below.

First, when the first motor 91 of the first elevation adjusting assembly 90 is driven in the positive direction by the controller 300, simultaneously the first screw bar 92 connected with the chain and sprocket is moved in the positive direction so as to move the axis S20 of the first adjusting rod 53 rightward with the rightward movement of the first adjusting nut 93 simultaneously.

Here, the first adjusting nut 93 is able to be moved forward or backward for a new adjustment by driving the first motor 91, even when the first elevating levers 52 are in a vertical reciprocating motion, wherein the equipment user can control the position of the first adjusting nut 93 automatically by using the controller 300 based on the longitudinal position of the first adjusting nut 93 detected by the sensor 94.

Next, when the first motor 91 of the first elevation adjusting assembly 90 is driven in the reverse direction by the controller 300, simultaneously the first screw bar 92 connected with the chain and sprocket is moved in the reverse direction so as to move the axis S20 of the first adjusting rod 53 leftward simultaneously with the leftward movement of the first adjusting nut 93.

Thus, the axis S20 of the first adjusting rod 53 can be adjusted or set leftward or rightward at a desired position by adjusting the first elevation adjusting assembly 90 by means of the controller 300.

The above described second elevation adjusting assembly 100 serves to adjust the vertically reciprocating elevation of the second working assembly 60, wherein the elevation adjusting assembly 100 comprises, as shown in FIGS. 15, 16*a*, 16*b* and 16*c*, a second motor 110 operating in a positive negative mode and electrically connected to a controller 300; a second screw bar 120 connected to the second motor 110; a second adjusting nut 130 screw engaged on the second screw bar 120 for longitudinal movement; and a second sensor 140 for detecting the position of the second adjusting nut 130, the sensor being electrically connected to the controller 300.

The second motor 110 electrically connected to a controller 300 is operated in a positive negative mode and is fixed firmly to the frame 1.

The second screw bar 120 acts to position the second adjusting nut 130 longitudinally on its length, wherein the bar 120 is rotatably fixed to the frame 1 via bearings and connected to the second motor 110 through the chain and sprocket.

The second adjusting nut 130 screw connected on the second screw bar 120 serves to move the axis S24 of the second adjusting rod 63 laterally, wherein the second adjusting nut 130 is connected to the second adjusting rod 63 through the axis S24.

The second sensor 140 connected electrically to the controller 300 detects the position of the second adjusting nut 130, wherein the second sensor 140 announces the position of the second adjusting nut 130 through the controller 300.

The operation of the second elevation adjusting assembly 100 constructed as above is described below.

First, when the second motor 110 of the second elevation adjusting assembly 100 is driven in the positive direction by the controller 300, simultaneously the second screw bar 120 connected with the chain and sprocket is moved in the positive direction so as to move the axis S24 of the second adjusting rod 63 rightward with the rightward movement of the second adjusting nut 130 simultaneously.

Here, the second adjusting nut 130 is able to be moved forward or backward for a new adjustment by driving the motor 110, even when the second elevating levers 62 are in a vertical reciprocating motion, wherein the apparatus user can control the position of the second adjusting nut 130 automatically by using the controller 300 based on the longitudinal position of the second adjusting nut 130 detected by the sensor 140.

Next, when the second motor 110 of the second elevation adjusting assembly 100 is driven in the reverse direction by the controller 300, simultaneously the second screw bar 120 connected with the chain and sprocket is moved in the reverse direction so as to move the axis S24 of the second adjusting rod 63 leftward simultaneously with the leftward movement of the second adjusting nut 130.

Thus, the axis S20 of the first adjusting rod 53 can be adjusted or set leftward or rightward at a desired position by adjusting the elevation adjusting assembly 90 by means of the controller 300.

Figure 18:
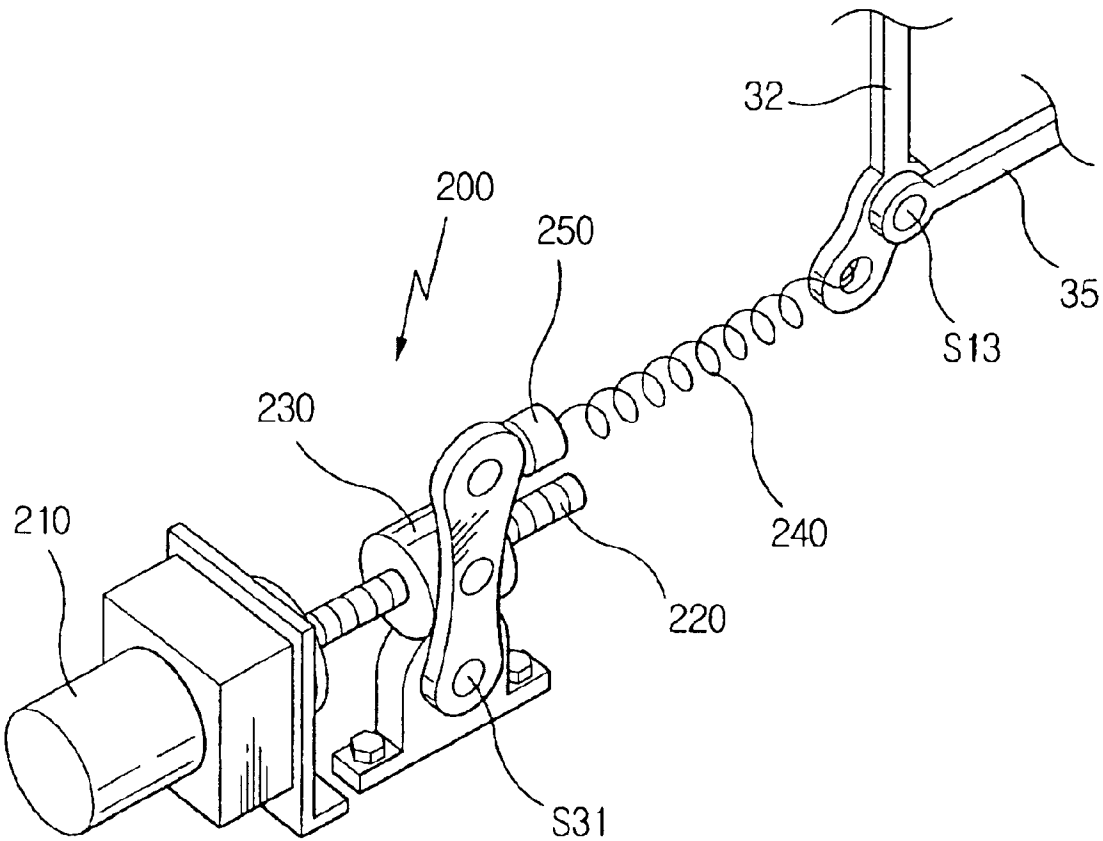
FIG. 18 shows the perspective view of a load adjusting assembly and FIG. 19 shows the operating states of the arrangement in FIG. 18.
Figure 19:
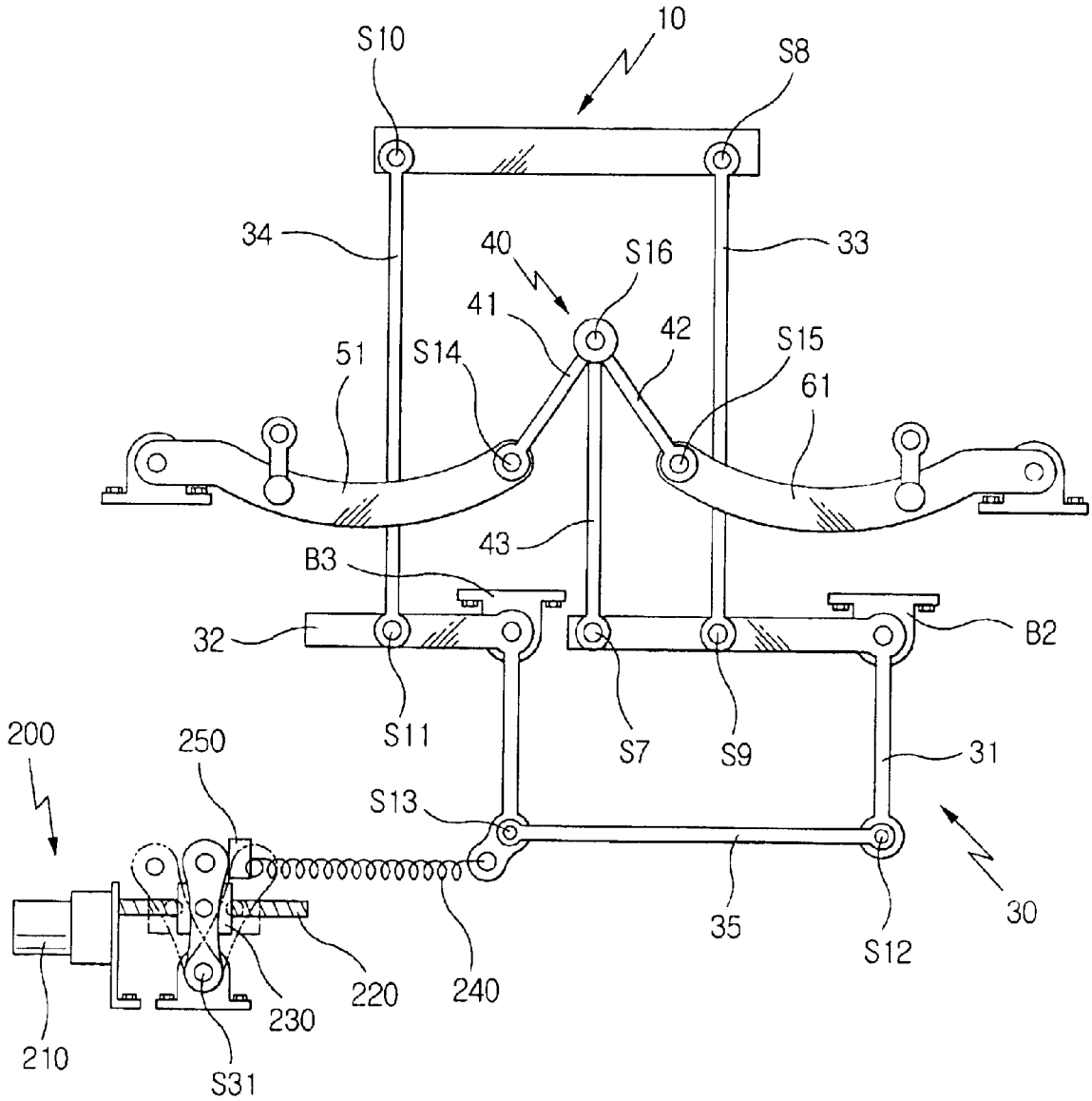

The load adjusting assembly 200 serves to adjust the load strength of the saddle support 10, the support being connected to the elevating assembly 30 and adapted for supporting the saddle 2, appropriately depending on the weight of the user, so as to prevent the driving assembly 70 and other parts from being overloaded, wherein the load adjusting assembly 200 comprises, as shown in FIGS. 18 and 19, a motor 210 operating in a positive negative mode and electrically connected to the controller 300; a screw bar 220 connected to the motor 210; an adjusting nut 230 screw engaged on the screw bar 220 so as to be movable longitudinally and fixed pivotally, at its bottom, to the frame 1 via an axis S31; a spring 240 connected, at its opposite ends, to the top of the adjusting nut 230 and the elevating assembly 30 respectively; and a load sensor 250 electrically connected to the controller 300 to detect the tension of the spring 240.

The motor 210 electrically connected to the controller 300 operates in a positive negative mode and is connected firmly to the frame 1.

The screw bar 220 connected to the motor 210 is used to position the adjusting nut 230 laterally on its length.

The adjusting nut 230 is screw engaged on the screw bar 220 so as to be movable laterally and fixed at its bottom to the frame 1 via an axis S31.

The spring 240 acts to render elastic the movement of the driven lever 32 of the elevating assembly 30, wherein the front end of the spring 240 is connected to a bottom point of the driven lever 32 and the rear end of the spring 240 is fixed to the adjusting nut 230.

The load sensor 250 electrically connected to the controller 300 acts to detect the tension of the spring 240 to display the tension value of the spring as detected through the controller 240.

The operation of the load adjusting assembly 200 is now described.

First, when the motor 210 of the load adjusting assembly 200 is driven in a positive direction by the controller 300, the screw bar 220 is concomitantly caused to operate in the positive direction, and then the adjusting nut 230 screwedly assembled on the screw bar 220 is moved somewhat leftward relative to the axis S31 as the rotation center, pulling the spring 240 leftward, or in the direction of the increased spring length., with the result that the driven and driving levers 32 and 31 of the elevating assembly 30 would be turned much about the axis S13 so as to raise the elevating rods 34 and 33 a great deal, whereby the support of the saddle support 10 by the elevating rods 34 and 33 would be conducted with a larger tension, that is, the load strength of the saddle support 10 becomes larger.

At this time, because the tension of the spring 240 is detected by the load sensor 250, the user can appropriately control the load strength of the saddle support 10 in accordance with his or her weight by automatically controlling the tension of the spring 240 through the controller 300.

Next, when the motor 210 of the load adjusting assembly 200 is driven in a negative direction by the controller 300, the screw bar 220 is concomitantly caused to operate in the negative direction, and then the adjusting nut 230 screwedly assembled on the screw bar 220 is moved somewhat rightward relative to the axis S31 as the rotation center, pulling the spring 240 rightward, or in the direction of the decreased spring length., with the result that the driven and driving levers 32 and 31 of the elevating assembly 30 would be turned less about the axis S13 so as to raise the elevating rods 34 and 33 meagerly, whereby the support of the saddle support 10 by the elevating rods 34 and 33 would be conducted with a smaller tension, that is, the load strength of the saddle support 10 becomes smaller.

Accordingly, for such load adjusting assemblies 200, the load strength of the saddle support 10 can be appropriately adjusted in accordance with the body weight of the user by driving the motor 210 in a positive or negative direction so as to tense or loosen the spring 240. As the result, a suitable load strength is given to the saddle support 10, so that the driving motor 71 may be prevented from being overloaded when the driving assembly 70 is operated and all component parts may be smoothly operated.

The above described controller 300 are electrically connected to the driving motor 71, motor 81, sensor 84, first motor 91, first sensor 94, second motor 110, second sensor 140, motor 210 and load sensor 250 respectively to control their operations, wherein the controller 300 is so arranged that it can control the motor 81 of the distance adjusting assembly 80, the first and second motors 91 and 110 of the first and second elevation adjusting assemblies 90 and 100, and the motor 210 of the load adjusting assembly 200.

Further, the controller 300 is equipped with a number of switches to control respective motors. The controller 300 is preferably installed in front of the horse saddle 2 so that the user can operate the switches while enjoying horse riding sport, although it may be installed at another proper place if desired.

Referring now to FIG. 5, the overall operation of the horse riding sporting apparatus according to the invention is described below.

Before beginning with horse riding sport, the load strength of the saddle support 10 may be properly adjusted depending on the weight of the user, i.e. the man intending to have a horse riding by controlling the motor 210 of the load adjusting assembly 200 using the controller 300. Particularly, the tension of the spring 240 is properly controlled to suit the body weight, e.g. 70 kg by driving the motor 210 of the load adjusting assembly 200 in the positive or its reverse direction by means of the controller 300, so that the both elevating rods 33 and 34 may support the saddle support 19 with the load strength of about 70 kg.

After controlling the load strength of the saddle support 10 properly according to the body weight through the load adjusting assembly 200, the user mounts the saddle to prepare for the horse riding sport. In that state, the user drives the driving motor 71 of the driving assembly 70, so that the driving force of the driving motor 71 may be transferred from the driving motor 71 through the reducer 71*a*, crank 72, connecting arm 73, connecting rod 75 and driving lever 74, in that order, to the first, second and third links 76, 77 and 78 to cause the latter members to conduct a horizontal reciprocal movements, wherein the first, second and third links 76, 77 and 78 are respectively connected to the first and second elevating levers 52 and 62 and the elevating levers 23 via axes S17, S29, S21, S30 and S3.

The horizontal reciprocation of the first link 76 causes the vertical reciprocation of the first elevating levers 52, so that the latter motion is transferred to the first working levers 51 to cause the vertical reciprocation of the axis S14. As the result, the first connecting levers 41 of the buffering member 40 connected to the axis S14 are concomitantly caused to make the corresponding vertical movement.

The horizontal reciprocation of the second link 77 causes the vertical reciprocation of the second elevating levers 62, so that the latter motion is transferred to the second working levers 61 to cause the vertical reciprocation of the axis S15. As the result, the second connecting levers 42 of the buffering member 40 connected to the axis S15 are concomitantly caused to make the corresponding vertical movement.

The elevating rod 43, which is connected, through the axis S16, to the first and second connecting levers 41 and 42, is caused to conduct the vertical reciprocation due to the vertical reciprocating movement of the latter members. As the result, the vertical reciprocating movement of the elevating rod 43 is transferred to the driving lever 31 and then to the driven lever 32 through the axis S17 and the connecting rod 35, to bring about the vertical reciprocating movements of the upright parallel elevating rods 33 and 34. Finally, the saddle support 10 connected to the tops of the elevating rods 33 and 34 through axes S8 and S10, the support 10 supporting the saddle 2, conducts smooth vertical reciprocating movements for the rider.

The horizontal reciprocating movements of the third link 78 cause the vertical reciprocating movements of the elevating levers 23 of the sliding assembly 20, which movements are transferred to the sliding levers 21 to result in the horizontal movements of the sliding rods 22. Resultantly, the saddle support 10, to which the sliding rods 22 are connected through axes S2, conducts smooth backward and forward movements in addition to smooth upward and downward movements as described above.

Therefore, the horizontal and vertical reciprocations of the horse saddle 2 fixed to the support 10 arise smoothly like wave motions, so that the rider sitting on the saddle 2 can feel the horse riding motion resembling the same rhythm and feeling as in a real horse riding and further the rider can enjoy a horse riding sport having full vividness, acquiring the excercise effects from the real horse riding.

Additionally, when the user, while in the process of horse riding sporting, changes the positions of the axes S20, S24 and S6, by driving the first motor 91, the second motor 110 and the motor 81 of the first height adjusting section 90, the second height adjusting section 100 and the horizontal distance adjusting section 80, in either direction, through access to the controller panel 300, as desired, the user can reset the hors riding state or atmosphere including the reciprocating heights and moving distance, so that a variety of rhythms or beats may be given to the saddle support 10 for a wide variety of horse riding movements.

On the other hand, as one example of various movements for the saddle 2 according to the invention, there is illustrated a case in which two vertical reciprocations of the horse saddle 10 for every horizontal reciprocation of the first, second and third link 76, 77 and 78 takes place. Such movements of the horse saddle 2 are described in detail below.

Referring to FIG. 6, as an illustrative example of operations, when the driving lever 74 of the driving assembly 70 is pushed in the direction of arrowhead or rightward, in the state that the first adjusting nut 93 of the first elevation adjusting assembly 90 is positioned at the position iv, the second adjusting nut 130 of the second elevation adjusting assembly 100 is positioned at the position ii, and the adjusting nut 83 of the distance adjusting assembly 80 is positioned at the position i, then the axis S14 of the first working levers 51 is caused to rise, as shown in the dotted line, due to the state of the first adjusting nut 93. The axis S15 is moved down, as in the dotted line, also due to the state of the second adjusting nut 130. At the same time, the axes S1 of the sliding levers 21 are moved rightward down, as in the dotted line, also due to the state of the adjusting nut 83.

Resultantly, the elevating rods 34 and 33 or the saddle 2 are lowered and concurrently the sliding rods 22 together with the saddle 2 are advanced forward, as shown in the dotted line, via the operations of the buffering member 40, the elevating assembly 30 and the sliding assembly 20, as described in the above.

On the other hand, when the driving lever 74 is pulled in the counter arrow direction or leftward, the axis 14 of the first working levers 51, the axis 15 of the second working levers 61, and the axes S1 of the transfer levers 21 are caused to move to the positions approximately reverse to or symmetric to the dotted lines as now shown. Only the positions for the driving and driven levers 31 and 32 would be the exception, because the ends of the levers 31 and 32 or the axes S9 and S11 have the top or upper limited positions, when the driving lever 74 is positioned at the neutral position or the axis 28 of the driving lever is positioned at the point ⓑ. Thus, in this case, the saddle 2 is moved down and concurrently moved rearward as the result.

Therefore, in the case that the first adjusting nut 93 of the first elevation adjusting assembly 90 and the second adjusting nut 130 of the second elevation adjusting assembly 100 are positioned symmetric to each to each other, as shown in FIG. 6, the driving lever 31 and the driven lever 32 or ultimately the saddle 2 makes two vertical reciprocations, every time the axis S28 of the driving lever 74 makes one horizontal cyclic travel over ⓐ⇆ⓒ. Although other examples of operations based on the typical positions of the adjusting means 93, 130 and 83 other than in FIG. 6 are not illustrated, those typical cases can be considered and readily understood, with reference to basic similar principles given in the foregoing.

The horse riding sporting apparatus according to the invention, so constructed and operated as described above, can conduct, by means of the saddle, the forward and rearward movement as well as the upward and downward movement in various modes, approximating the rhythms and beats of a real horse, so that the user can feel the playing pleasure and active vividness, as if he would ride a real horse.

Further, the horse riding sporting apparatuses according to the invention have the advantage that users can enjoy the horse riding sport full of vividness, with convenience and ease, in narrow indoor spaces such as ordinary houses, health clubs, gyms etc. without need for high priced horses.

Furthermore, the horse riding sporting apparatuses according to the invention does not require the user to be laborous in contrast with the conventional health oriented exercise but the user only needs to keep his balances against possible fall while sitting on the saddle, so as to maintain the horse riding naturally. In addition, he is prone to think himself as riding a real horse, so that he can conduct the safe, burden free and pleasant sport, good for the whole body exercise, physical drill and flexibility.

What is claimed is:

1. A horse riding sporting apparatus comprising: a saddle support(10) for supporting a saddle(2), the support being disposed in the upper central part of a frame(1); a sliding assembly(20) for moving forward and backward the saddle support(10), the sliding assembly being disposed in the front part of the frame(1); an elevating assembly(30) for moving up and down the saddle support(10), the elevating assembly being disposed in the central part of the frame(1); a buffering member(40) connected to the elevating assembly(30); a first working assembly(50) and a second working assembly(60), for moving up and down the buffering member(40), the first and second working assemblies being respectively disposed in the rear and the central part of the frame(1); a driving assembly(70) for driving the sliding assembly(20) as well as the first and second working assemblies(50 and 60); a distance adjusting assembly(80) as well as a first and a second elevation adjusting assembly(90 and 100), respectively for adjusting the sliding distance as well as the vertical elevation; a load adjusting assembly(200) for adjusting the load strength for the saddle support(10), the load adjusting assembly being connected to the elevating assembly(30); and a controller(300) for automatically controlling the operation of the above described components.

2. The apparatus according to claim 1, wherein the sliding assembly comprises sliding levers(21) fixed to the frame(1) through bearings(B1); sliding rods(22), the opposite ends of the sliding rods being connected to the tops of the sliding levers(21) and to the saddle support(10) through axes(S1 and S2); elevating levers(23), the tops and bottoms of the elevating levers being respectively connected to the bottom ends of the sliding levers(21) and the driving assembly(70) through axis(S4 and S3); and an adjusting rod(24), the top and bottom of the adjusting rod being connected to the elevating levers(23) and the distance adjusting assembly(80) through an axis(S5, S6).

3. The apparatus according to claim 1, wherein the elevating assembly(30) comprises a driving lever(31) fixed to the frame(1) through bearings(B2) and connected to the buffering member(40) through an axis(S7); driven lever(32) fixed to the frame(1) through a bearing(B3); elevating rods(33, 34), the respective tops and bottoms of said elevating rods being connected to the saddle support(10) and to the upper positions of the driving and driven levers(31 and 32) through axes(S8, S9; S10, S11); and a connecting rod(35), the opposite ends of connecting rod being connected to the lower ends of the driving and driven levers(31 and 32) through an axis(12, 13).

4. The apparatus according to claim 1, wherein the buffering member (40) comprises a set of first and second connecting levers(41 and 42), the bottoms of the levers being connected to the first and second working assemblies (50 and 60) via axes(S14 and S15) respectively, and the respective top ends of the levers being connected to each other by an axis(S16); and an elevating rod(43), the top and bottom of the rod being connected to the tops of the first and second connecting levers(41 and 42), and connected to the elevating assembly(30) via axis(S16 and S7) respectively.

5. The apparatus according to claim 4, wherein the elevating rod is connected, at its bottom, with the driving lever(31) of the elevating assembly(30) via a axis(S7).

6. The apparatus according to claim 1, wherein the first working assembly(50) comprises first working levers(51) fixed to the frame(1) via bearings(B4) and connected to the buffering member(40) via an axis(S14); first elevating levers (52) connected, at their bottom and top, to the working levers(51) and to the driving assembly(70) via an axis(S18 and S17); and first adjusting rod(53) connected, at its top and bottom, to the first elevating levers(52) and to the first elevation adjusting assembly(90) via axes(S19 and S20).

7. The apparatus according to claim 6, wherein the first working levers(51) are connected, at their front ends, to first connecting levers(41) of the buffering member(40) via an axis(14).

8. The apparatus according to claim 1, wherein the second working assembly(60) comprises second working levers(61) fixed to the frame(1) via bearings(B5) and connected to the buffering member(40) via an axis(S15); the second elevating levers(62) connected, at their bottom and top, to the working levers(61) and to the driving assembly(70) via axis(S22) and axis(S21); and the second adjusting rod(63) connected, at its top and bottom, to the second elevating levers(62) and to the second elevation adjusting assembly(100) via axes(S23 and S24).

9. The apparatus according to claim 8, wherein the second working levers(61) are connected, at their rear ends, to the second connecting levers(42) of the buffering member(40) via an axis(15).

10. The apparatus according to claim 1, wherein the driving assembly(70) comprises a driving motor(71) electrically connected to the controller(300) and equipped with a speed reducer(71*a*); a crank(72) connected to the speed reducer(71*a*) through an eccentric shaft(72*a*); a connecting arm(73) connected to the crank(72) through an axis(S25) and fixed, at its bottom, to the frame(1) through a bearing (B6); a driving lever(74) fixed, at its middle point, to the rear point of the frame(1) through bearings(B7); a connecting rod(75) connected, at its opposite ends, to the connecting arm(73) and to the bottom of the driving lever(74) through axes(S26 and S27); and a first, second and third link(76, 77 and 78) for being moved forward and backward by the driving lever(74) and for operating both the sliding assembly (20) and the first and second working assemblies(50 and 60).

11. The apparatus according to claim 10, wherein the first link(76) is connected, at its opposite ends, to the top of the driving lever(74) and the first elevating levers(52) of the first working assembly(50) through the axes(S28 and S17).

12. The apparatus according to claim 10, wherein the second link(77) is connected, at its opposite ends, to the first elevating levers(52) of the first working assembly(50) and the second elevating levers(62) of the second working assembly(60) through axes(S29 and S21).

13. The apparatus according to claim 10, wherein the third link(78) is connected, at its opposite ends, to the second elevating levers(62) and the elevating levers(23) of the sliding assembly(20) through axes(S30 and S3).

14. The apparatus according to claim 1, wherein the adjusting assembly(80) comprises a motor(81) operating in a positive negative mode and electrically connected to the controller(300); a screw bar(82) connected to the motor(81); an adjusting nut(83) screw engaged on the screw bar(82) for longitudinal movement; and a sensor(84) for detecting the position of the adjusting nut(83), the sensor being electrically connected to the controller(300).

15. The apparatus according to claim 14, wherein the adjusting nut(83) is connected to the adjusting rod(24) via an axis(S6).

16. The apparatus according to claim 1, wherein the first elevation adjusting assembly(90) comprises a first motor (91) operating in a positive negative mode and electrically connected to the controller(300); a first screw bar(92) connected to the first motor(91); a first adjusting nut(93) screw engaged on the first screw bar(92) for longitudinal movement; and a first sensor(94) for detecting the position of the first adjusting nut(93), the sensor being electrically connected to the controller(300).

17. The apparatus according to claim 16, wherein the adjusting nut(93) is connected to first adjusting rod(53) through the axis(S20).

18. The apparatus according to claim 1, wherein the second elevation adjusting assembly(100) comprises a second motor(110) operating in a positive negative mode and electrically connected to the controller(300); a second screw bar(120) connected to the second motor(110); a second adjusting nut(130) screw engaged on the second screw bar(120) for longitudinal movement; and a second sensor (140) for detecting the position of the second adjusting nut(130), the sensor being electrically connected to the controller(300).

19. The apparatus according to claim 18, wherein the second adjusting nut(130) is connected to the second adjusting rod(63) of the second working assembly(60) through the axis(S24).

20. The apparatus according to claim 1, wherein the load adjusting assembly(200) comprises a motor(210) operating in a positive negative mode and electrically connected to the controller(300); a screw bar(220) connected to the motor (210); an adjusting nut(230) screw engaged on the screw bar(220) so as to be movable longitudinally and fixed pivotally, at its bottom, to the frame(1) via an axis(S31); a spring(240) connected, at its opposite ends, to the top of the adjusting nut(230) and the elevating assembly(30) respectively; and a load sensor(250) electrically connected to the controller(300) to detect the tension of the spring(240).

21. The apparatus according to claim 20, wherein the spring(240) is connected to the driven lever(32) of the elevating assembly(30) via the axis(S13).

22. The apparatus according to claim 1, wherein the controller(300) is so arranged that it can control a motor(81) of the distance adjusting assembly(80), first and second motors(91, 110) of the first and second elevation adjusting assemblies(90, 100), and motor(210) of the load adjusting assembly(200).

* * * * *